US011284688B2

(12) United States Patent
Dobashi

(10) Patent No.: US 11,284,688 B2
(45) Date of Patent: Mar. 29, 2022

(54) ORNAMENTS

(71) Applicant: CROSSFOR CO., LTD., Yamanashi (JP)

(72) Inventor: Hidetaka Dobashi, Yamanashi (JP)

(73) Assignee: CROSSFOR CO., LTD., Yamanashi (JP)

( * ) Notice: Subject to any disclaimer, the term of this patent is extended or adjusted under 35 U.S.C. 154(b) by 448 days.

(21) Appl. No.: 16/086,424

(22) PCT Filed: May 15, 2018

(86) PCT No.: PCT/JP2018/018782
§ 371 (c)(1),
(2) Date: Sep. 19, 2018

(87) PCT Pub. No.: WO2018/212191
PCT Pub. Date: Nov. 22, 2018

(65) Prior Publication Data

US 2021/0120921 A1 Apr. 29, 2021

(30) Foreign Application Priority Data

May 19, 2017 (JP) ..... JP2017-099839

(51) Int. Cl.
*A44C 17/02* (2006.01)
*A44C 25/00* (2006.01)

(52) U.S. Cl.
CPC ..... *A44C 17/0258* (2013.01); *A44C 17/0275* (2013.01); *A44C 25/001* (2013.01)

(58) Field of Classification Search
CPC ..... A44C 17/0275; A44C 17/0258; A44C 25/001; A44C 17/0266
(Continued)

(56) References Cited

U.S. PATENT DOCUMENTS 9,167,872 B2 * 10/2015 Dobashi ..... A44C 17/00
9,888,749 B1 * 2/2018 Kawakami ..... A44C 25/001
(Continued)

FOREIGN PATENT DOCUMENTS

CN 202959084 U 6/2013
CN 205728455 U 11/2016
(Continued)

OTHER PUBLICATIONS

Chinese Office Action dated May 13, 2019, in connection with corresponding CN Application No. 201810478818.2 (21 pp., including machine-generated English translation).
(Continued)

*Primary Examiner* — Jack W Lavinder
(74) *Attorney, Agent, or Firm* — Maier & Maier, PLLC

(57) ABSTRACT

A personal ornament that includes: a base portion that includes a pair of right-and-left base-side engaging ring portions, and fixes and holds a gemstone; and a frame portion that includes a pair of right-and-left frame-side engaging ring portions to be coupled to the base-side engaging ring portions, and that supports the base portion, the base portion and the gemstone being supported to be swingable with respect to the frame portion. The personal ornament also includes a protective member that protects, from an outside, at least the frame-side engaging ring portions, and coupling parts of the base-side engaging ring portions with respect to the frame-side engaging ring portions.

13 Claims, 17 Drawing Sheets

(58) Field of Classification Search
USPC ..... 63/27, 28, 36
See application file for complete search history.

(56) References Cited

U.S. PATENT DOCUMENTS

| | | | | |
|---|---|---|---|---|
| 2003/0172673 | A1* | 9/2003 | Kimura | A44C 17/0258 63/29.1 |
| 2005/0022555 | A1* | 2/2005 | Cheng | A44C 9/00 63/31 |
| 2012/0151963 | A1* | 6/2012 | Dobashi | A44C 17/0258 63/26 |
| 2013/0239613 | A1* | 9/2013 | Shah | A44C 17/0275 63/27 |

FOREIGN PATENT DOCUMENTS

| | | | |
|---|---|---|---|
| CN | 205963155 | U | 2/2017 |
| CN | 206079328 | U | 4/2017 |
| EP | 3 566 604 | A1 | 11/2019 |
| JP | 2006-192054 | A | 7/2006 |
| JP | 2009-268573 | A | 11/2009 |
| JP | 3175111 | U | 3/2012 |
| JP | 2015-54162 | A | 3/2015 |
| JP | 2016-41381 | A | 3/2016 |
| WO | 2019/124168 | A1 | 6/2019 |

OTHER PUBLICATIONS

Chinese Office Action dated Oct. 31, 2019, in connection with corresponding CN Application No. 201810478818.2 (24 pp., including machine-generated English translation).
Chinese Office Action dated Jan. 16, 2020, in connection with corresponding CN Application No. 201810478818.2 (22 pp., including machine-generated English translation).
European Search Report dated Oct. 22, 2019, including the Supplementary European Search Report and the European Search Opinion, in connection with corresponding EP Application No. 18769579.6 (10 pp.).
Taiwanese Office Action dated Jun. 28, 2019, in connection with corresponding TW Application No. 107146019 (20 pp., including machine-generated English translation).
Notification of Reasons for Refusal dated Sep. 26, 2017 and Decision to Grant a Patent dated Jan. 24, 2018 in corresponding Japanese Application No. 2017-99839; 15 pages.
Applicant's Amendment and Argument filed on Dec. 27, 2017 in corresponding Japanese Application No. 2017-99839; 25 pages.
Decision to Grant a Patent dated Jan. 24, 2018 of corresponding Japanese Application No. 2017-099839; 6 pgs.
International Preliminary Report on Patentability dated Nov. 19, 2019, in corresponding International Application No. PCT/JP2018/018782; 5 pages.

* cited by examiner

--Prior Art--

--Prior Art--

ORNAMENTS

FIELD

The present invention relates to personal ornaments such as a pendant and a pierced earring that use a gemstone, and more particularly, to personal ornaments in which the gemstone and a base portion that fixes and holds the gemstone are arranged to be swingable with respect to a frame portion such that the gemstone can look more brilliant.

BACKGROUND

As an example of the personal ornaments such as the pendant (necklace) and the pierced earring, there has been known one in which the gemstone such as a diamond is held by the base portion, and the gemstone and the base portion are arranged to minutely swing. When the gemstone held by the base portion minutely swing in this way, the gemstone looks more sparkly than in being stationary. Thus, beauty of the gemstone can be further emphasized.

An example of the personal ornaments in which the gemstone is arranged to be swingable in this way is described in Japanese Patent Application Laid-open No. 2015-54162 (Patent Literature 1), in which a pendant to be attached to a chain of a pendant is disclosed as an embodiment. Below, the pendant of Patent Literature 1 is briefly described with reference to FIG. 19 and FIG. 20.

A pendant 70 illustrated in FIG. 19 and FIG. 20 includes a base portion 72 that fixes and holds a diamond 71 being the gemstone, and a frame portion 81 that supports the base portion 72. The base portion 72 includes a base body portion 73 on which the diamond (gemstone) 71 is held, right-and-left arm portions 74 that extend from both right-and-left sides of the base body portion 73 to an outside in a width direction, and right-and-left annular base-side engaging ring portions 75 that are arranged at distal end portions of the arm portions 74. Further, the base body portion 73 is provided with a plurality of claw portions 76 for fixing the diamond 71.

The right-and-left arm portions 74 and the right-and-left base-side engaging ring portions 75 are arranged such that, in a side view of the pendant 70, orientations of a front and a rear of each of the ring portions 75 are inclined with respect to a table surface of the diamond 71 that is held by the base portion 72. In particular, in Patent Literature 1, the right-and-left arm portions 74 and the right-and-left base-side engaging ring portions 75 are arranged such that the table surface of the diamond 71 that is held by the base portion 72 is oriented obliquely upward when the front and the rear of each of the base-side engaging ring portions 75 are parallel to a gravity direction (when a central opening portion of each of the base-side engaging ring portions 75 is oriented in a horizontal direction).

Further, the base portion 72 of Patent Literature 1 is formed such that, when the base-side engaging ring portions 75 are supported by the frame portion 81 by being coupled to frame-side engaging ring portions 82 described below of the frame portion 81, in the side view of the pendant 70, a position of a contact point where the base-side engaging ring portion 75 is held in contact with the frame-side engaging ring portion 82 is arranged above a position of a center of gravity of the diamond 71 and the base portion 72 as a whole in the gravity direction.

The frame portion 81 of Patent Literature 1 includes a frame body portion 83 that has an inverted V-shape in the front view, and the right-and-left frame-side engaging ring portions 82 that are provided on back surfaces of right-and-left lower end portions of the frame body portion 83. Further, a chain-link hole portion 84 for coupling a chain of a pendant is provided in a right-and-left direction (width direction of the pendant 70) through an upper end portion of the frame body portion 83.

The right-and-left frame-side engaging ring portions 82 are formed integrally with the frame body portion 83 such that central opening portions of the frame-side engaging ring portions 82 are oriented in the right-and-left direction when the pendant 70 is suspended from the chain. The right-and-left base-side engaging ring portions 75 of the base portion 72 are respectively coupled to and engaged with such right-and-left frame-side engaging ring portions 82. In this case, the frame-side engaging ring portion 82 and the base-side engaging ring portions 75 are engaged with each other such that the ring portions pass through central opening portions on mating sides, and that inner rim portions on the mating sides are brought into contact with each other.

In such a pendant 70 of Patent Literature 1, the base portion 72 is held by the frame portion 81 in a manner that the inner rim portions of the right-and-left base-side engaging ring portions 75 are brought into contact with and hooked to the inner rim portions of the right-and-left frame-side engaging ring portions 82 of the frame portion 81. With this, for example, when the pendant 70 is shifted or swung, the base portion 72 and the diamond 71 held by the base portion 72 can be minutely swung in a front-and-rear direction in a state of being suspended from the frame portion 81. When the diamond 71 minutely swings in this way, brilliance of the diamond 71 can be beautifully enhanced.

In particular, in the pendant 70 of Patent Literature 1, the base portion 72 is supported by the frame portion 81 such that the table surface of the diamond 71 is oriented obliquely upward when the pendant is formed. With this, on the chest of a user wearing the pendant, the brilliance of the diamond 71 can be more advantageously enhanced such that the table surface of the diamond 71 is likely to catch eyes of others.

Further, Patent Literature 1 describes that any one or both of the base-side engaging ring portion 75 and the frame-side engaging ring portion 82 are formed to have a shape tapered toward an inner rim in cross-section orthogonal to its circumferential direction. With this, a contact area of the base-side engaging ring portion 75 and the frame-side engaging ring portion 82 at the time when both the members are engaged with each other can be reduced, and hence frictional resistance during the swing of the base portion 72 can be reduced. Thus, a duration for which the diamond 71 swings can be prolonged.

CITATION LIST

Patent Literature

[PTL 1] Japanese Patent Application Laid-open No. 2015-54162

SUMMARY

Technical Problem

In the pendant 70 described in Patent Literature 1, as described above, the base portion 72 is supported by the frame portion 81 through intermediation of the base-side engaging ring portions 75 and the frame-side engaging ring portions 82. With this, the diamond 71 held by the base portion 72 can be minutely swung.

However, in the case of the pendant 70 of Patent Literature 1, the base-side engaging ring portions 75 of the base portion 72 are each arranged in a bare state of being exposed in directions of a forward side (front side), a backward side (rear side), an upper side, a lower side, outer lateral sides in the width direction (right-and-left direction) of the pendant 70. Further, the frame-side engaging ring portions 82 of the frame portion 81 are each arranged under a state in which a front surface (front) side of each of the frame-side engaging ring portions 82 is covered with the frame body portion 83, and in which a backward side (rear side), an upper side, a lower side, outer lateral sides in the width direction of the same are exposed.

Thus, when the pendant 70 is used as a pendant by attaching the chain thereto, the base-side engaging ring portions 75 and the frame-side engaging ring portions 82, which are exposed to the outside, may hit or collide against other objects (articles). As a result, the base-side engaging ring portions 75 and the frame-side engaging ring portions 82 may locally receive unexpected load (external force), or may receive high load by being forcefully pressed by accident.

Meanwhile, in this pendant 70, the structure that causes the diamond 71 to swing through intermediation of the base-side engaging ring portions 75 and the frame-side engaging ring portions 82 is formed delicately and in a small size, and hence has properties of being vulnerable to deformation. Thus, when the base-side engaging ring portions 75 and the frame-side engaging ring portions 82 locally or forcefully receive the force (external force) from the outside as described above, the base-side engaging ring portions 75 and the frame-side engaging ring portions 82 are liable to be deformed, for example, to warp. As a result, for example, a problem that the minute swinging movement of the diamond 71 as described above cannot be smoothly performed or cannot be performed any longer, and a problem that the base portion 72 is disengaged from the frame portion 81 may be caused.

Further, when the base-side engaging ring portions 75 and the frame-side engaging ring portions 82 of the pendant 70 are exposed to the outside, it is conceivable that hair strands and threads of clothes, a scarf, or the like of the user may be entangled in these base-side engaging ring portions 75 and frame-side engaging ring portions 82. Also when the base-side engaging ring portions 75 and the frame-side engaging ring portions 82 in which the threads and the like are entangled in this way are left as they are, the minute swinging movement of the diamond 71 may be hindered.

In addition, when the base-side engaging ring portions 75 and the frame-side engaging ring portions 82 are arranged in the state of being exposed to the outside, there is a disadvantage that variations in design of the pendant 70 are restricted.

The present invention has been made in view of the above-described problems, and a specific object thereof is to provide a personal ornament capable of preventing base-side engaging ring portions and frame-side engaging ring portions that couple a base portion and a frame portion to each other from directly receiving external force, and of stably maintaining, for a long duration, a state in which a gemstone that is held by the base portion is minutely swingable.

Solution to Problem

According to a first aspect of the present invention, there is provided a personal ornament including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized by including a protective member that protects, from an outside, at least the right-and-left frame-side engaging ring portions, and coupling parts of the right-and-left base-side engaging ring portions with respect to the frame-side engaging ring portions under the state in which the base-side engaging ring portions and the frame-side engaging ring portions are coupled to each other, the personal ornament being characterized in that the protective member includes:

a front part that covers and protects front sides of the right-and-left frame-side engaging ring portions, and front sides of the coupling parts of the right-and-left base-side engaging ring portions such that the front sides of the right-and-left frame-side engaging ring portions, and the front sides of the coupling parts of the right-and-left base-side engaging ring portions are not exposed; and a rear part that covers and protects rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part.

According to a second aspect of the present invention, there is provided a personal ornament including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized in that the frame portion includes:

a front part that covers and protects, under the state in which the base-side engaging ring portions and the frame-side engaging ring portions are coupled to each other, at least front sides of the right-and-left frame-side engaging ring portions, and front sides of coupling parts of the right-and-left base-side engaging ring portions with respect to the frame-side engaging ring portions such that the front sides of the right-and-left frame-side engaging ring portions, and the front sides of the coupling parts of the right-and-left base-side engaging ring portions are not exposed; and a rear part that covers and protects, under the state in which the base-side engaging ring portions and the frame-side engaging ring portions are coupled to each other, at least rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part, the personal ornament being also characterized in that a housing compartment that houses therein and protects, from an outside, at least the frame-side engaging ring portions, and the coupling parts of the base-side engaging ring portions, is arranged between the front part and the rear part.

Advantageous Effects of Invention

According to the present invention, it is possible to provide a personal ornament capable of preventing parts that couple a base portion to fix and hold a gemstone, and a frame portion to support the base portion to each other from directly receiving external force, and of stably maintaining, for a long duration, a state in which the gemstone that is held by the base portion is minutely swingable.

DETAILED DESCRIPTION

Below, some Examples of a personal ornament according to an embodiment of the present invention are described in detail with reference to the drawings. Note that, the present invention is not limited to Examples described below, and various changes may be made thereto as long as configurations substantially the same as that of the present invention are provided, and as long as functions and advantages similar to those of the present invention are obtained.

Example 1

Figure 1:
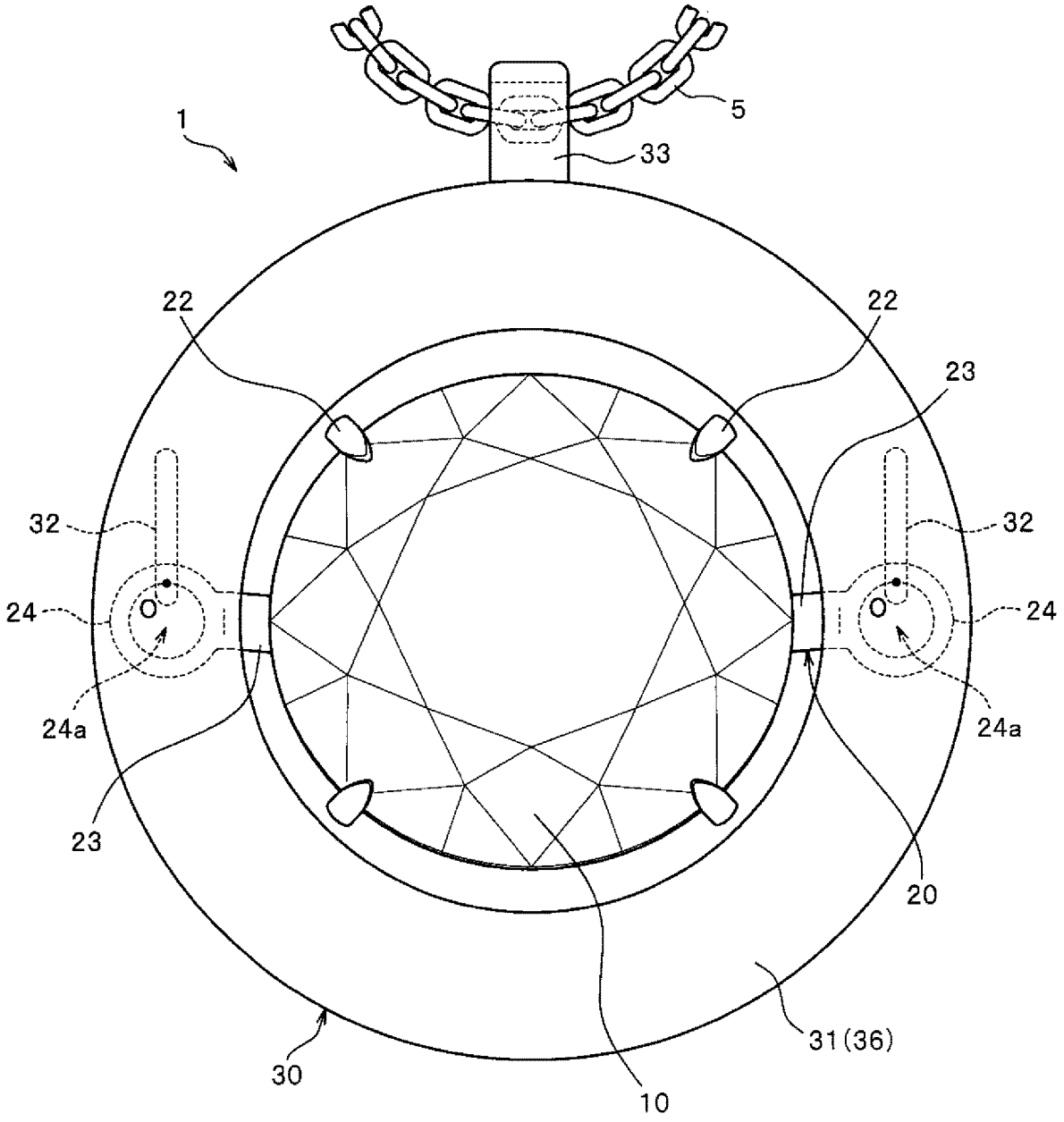
FIG. 1 A front view illustrating a pendant according to Example 1 of the present invention.
Figure 2:
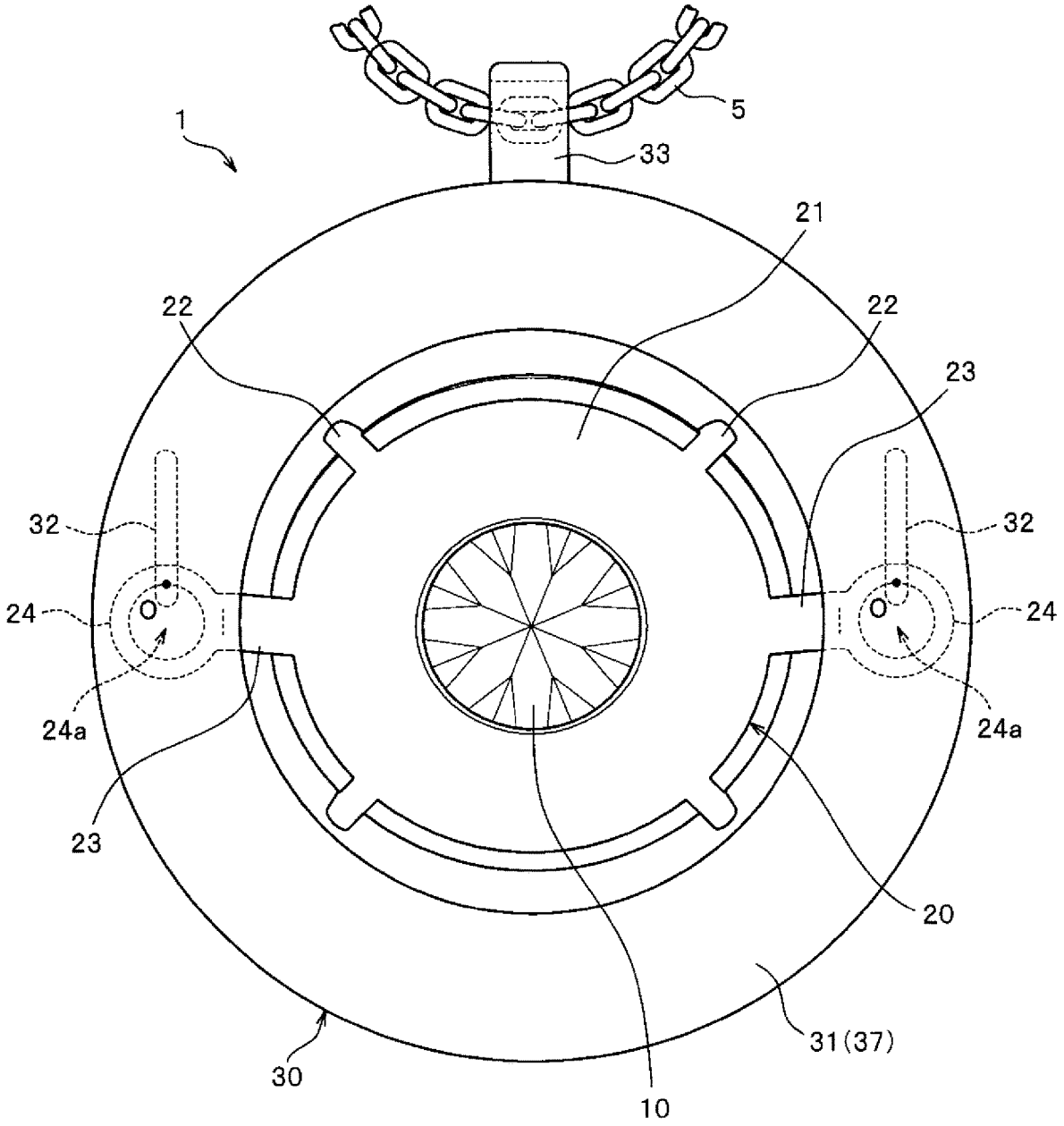
FIG. 2 A rear view of the pendant.
Figure 3:
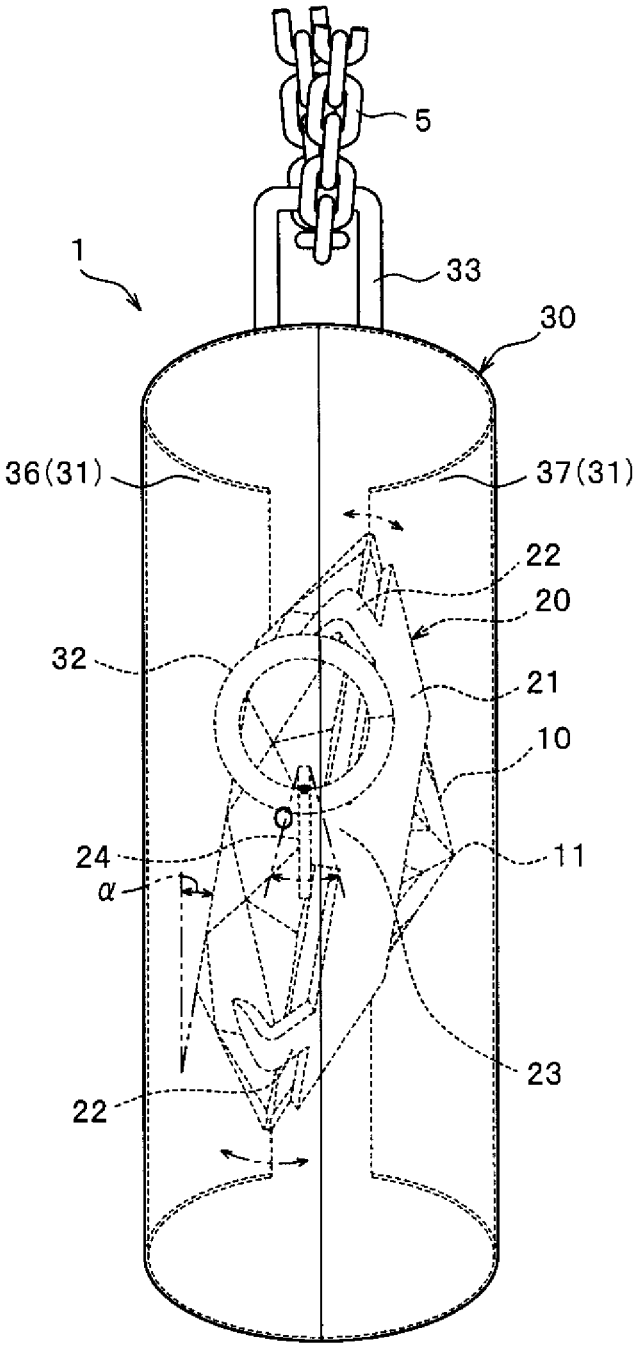
FIG. 3 A side view of the pendant.

FIG. 1 is a front view illustrating a pendant according to Example 1. FIG. 2 and FIG. 3 are a rear view and a side view of the pendant.

In the description hereinbelow, in a personal ornament (pendant), three directions orthogonal to each other are referred to as an upper-and-lower direction, a width direction (also referred to as right-and-left direction), and a front-and-rear direction. Specifically, a direction in which a pair of base-side engaging ring portions 24 are arranged with respect to a gemstone 10 described below is defined as the width direction, a direction in which mainly a front side and a back side of the gemstone 10 (for example, table surface and culet portion 11 of the gemstone 10) are oriented is defined as the front-and-rear direction, and a direction orthogonal to the width direction and the front-and-rear direction is defined as the upper-and-lower direction. In other words, the upper-and-lower direction and the right-and-left direction correspond to an upper-and-lower direction and a right-and-left direction under a state in which the pendant is attached to a chain of the pendant and picked up. The front-and-rear direction corresponds to a direction on a front side (forward side) and a direction on a rear side (backward side) of the pendant at a time when the pendant is worn.

A pendant 1 according to Example 1 is attached to string-like members such as a chain 5. With this, the pendant (or necklace) as a personal ornament is formed. The pendant 1 of Example 1 includes a base portion 20 that fixes and holds a diamond as the gemstone 10, and a frame portion 30 that swingably supports the base portion 20 and the gemstone (diamond) 10. Further, a part of the frame portion 30 of Example 1 (frame body portion 31 described below) is formed also as a protective member as described below.

Note that, the gemstone 10 that is held by the base portion 20 may be, for example, natural gemstones (natural minerals) other than the diamond, such as a sapphire, may be synthetic gemstones (artificial gemstones) that use synthetic minerals, or may be imitation gemstones that use glass or the like.

The base portion 20 and the gemstone 10 are supported to be swingable with respect to the frame portion 30 in a state of being suspended therefrom such that the front side (for example, table surface) of the gemstone 10 is viewed from the front.

Figure 4:
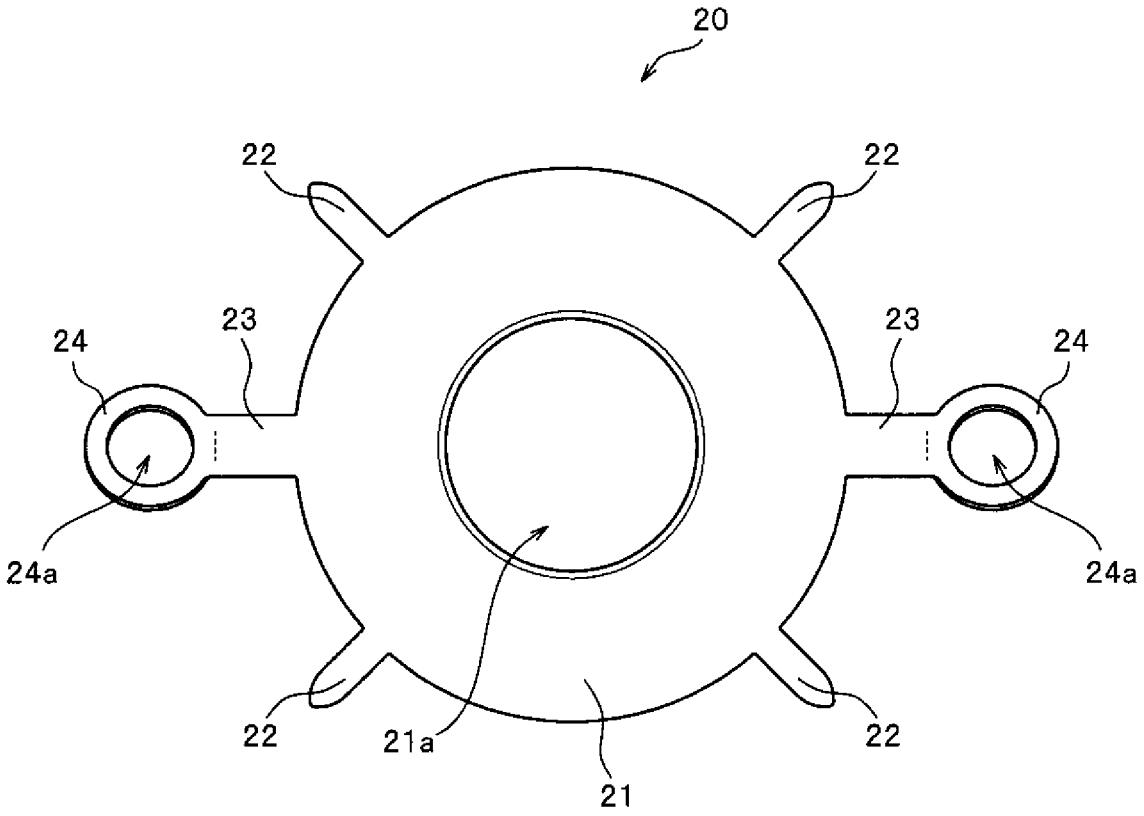
FIG. 4 A schematic view in which a base portion to be arranged in the pendant is viewed from a rear (back surface) side of a side on which a gemstone is held, the base portion being viewed under a state in which the gemstone is not held.

As illustrated in FIG. 4, the base portion 20 of Example 1 includes a base body portion 21 on which the gemstone 10 is set, a plurality of claw portions 22 that are provided to protrude from the base body portion 21 and fix the gemstone 10, right-and-left arm portions 23 that extend from right-and-left lateral rim portions (lateral end portions) of the base body portion 21 to an outside in the width direction of the base portion 20, and the right-and-left base-side engaging ring portions 24 that are arranged at distal end portions of the right-and-left arm portions 23. The right-and-left base-side engaging ring portions 24 are arranged at positions on sides opposite to each other across the gemstone 10.

An entirety of the base portion 20 of Example 1 is integrally formed as a single member by performing press working (punch press working) or the like on a sheet made of a precious metal such as gold, platinum, or silver. Note that, materials of and preparation methods for the base portion 20 are not particularly limited. In addition, for example, shapes of the base body portion 21 and the claw portions 22, and the number of the claw portions 22 to be arranged are not limited as well, and can be arbitrarily changed.

A circular opening portion 21*a* is formed at a central portion of the base body portion 21, and the gemstone 10 is fixed and held by the base portion 20 with its culet portion 11 being protruded backward through the opening portion 21*a* of the base body portion 21. The right-and-left arm portions 23 of the base portion 20 are parts that connect the base body portion 21 and the right-and-left base-side engaging ring portions 24 to each other. The right-and-left arm portions 23 have shapes right-left symmetrical with each other, extend to the outside in the right-and-left direction from the base body portion 21, and are arranged with a forward inclination. Such right-and-left arm portions 23 are variable in length in accordance, for example, with design of the pendant 1, and, when necessary, the base portion 20 may be formed without providing the right-and-left arm portions 23.

The right-and-left base-side engaging ring portions 24 of the base portion 20 are each formed into an annular shape, and circular central-opening portions 24*a* are provided at their central portions. The right-and-left base-side engaging ring portions 24 are provided at positions corresponding to each other on right-and-left lateral sides of the base body portion 21. In the front view of the pendant 1, the gemstone 10 is arranged between the right-and-left base-side engaging ring portions 24. In Example 1, the right-and-left base-side engaging ring portions 24 are formed integrally with the base body portion 21 through intermediation of the right-and-left arm portions 23. Note that, in the present invention, the right-and-left base-side engaging ring portions 24 may be formed as members separate from the base body portion 21, and may be connected through intermediation of the right-and-left arm portions 23.

Figure 6:
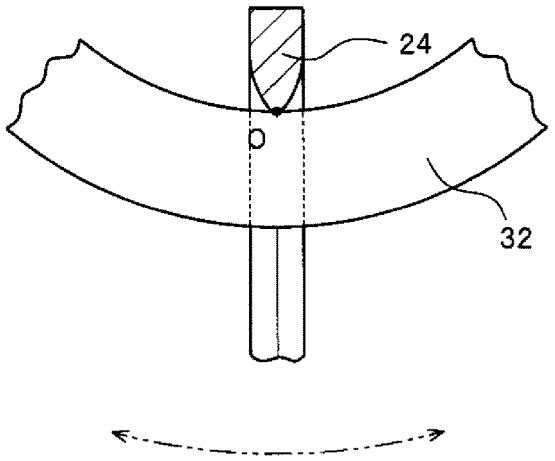
FIG. 6 An explanatory view schematically illustrating a state in which a base-side engaging ring portion of the base portion is engaged with a frame-side engaging ring portion of the frame portion.

Such right-and-left annular base-side engaging ring portions 24 and frame-side engaging ring portions 32 described below of the frame portion 30 are engaged with each other such that the ring portions pass through central opening portions on mating sides each other, and that inner rim portions on the mating sides are brought into contact each other. Further, the base-side engaging ring portions 24 are each formed into a modified cross-sectional shape other than the circular shape in cross-section orthogonal to a circumferential direction of the base-side engaging ring portions 24. For example, as illustrated in FIG. 6, the base-side engaging ring portions 24 of Example 1 are each formed such that a distal end portion on an inner peripheral side of the base-side engaging ring portion 24 is sharpened. In this example, the base-side engaging ring portions 24 are each formed into a tapered shape being gradually narrowed toward the inner rim in the cross-section orthogonal to the circumferential direction.

With this, when the base-side engaging ring portion 24 is coupled to the frame-side engaging ring portion 32 of the frame portion 30, a contact area of the base-side engaging ring portion 24 at a contact point O where the base-side engaging ring portion 24 and the frame-side engaging ring portion 32 intersect and are held in contact with each other can be reduced. As a result, when the base portion 20 swings in the front-and-rear direction with respect to the frame portion 30, frictional resistance of the base-side engaging ring portion 24 against the frame-side engaging ring portion 32 can be reduced. Thus, the base portion 20 and the gemstone 10 can be swung minutely and smoothly with respect to the frame portion 30. Further, the swinging movement of the base portion 20 and the gemstone 10 can be continued relatively long without interruption, and hence their swing duration can be prolonged. Note that, in the present invention, the cross-sectional shape of the base-side engaging ring portion 24 is not limited to the example of FIG. 6, and the base-side engaging ring portion 24 may be formed into other shapes such as a circular shape in cross-section.

In the base portion 20 of Example 1, positions and orientations of the base-side engaging ring portions 24 with respect to the base body portion 21 are set such that, when the gemstone 10 and the base portion 20 are supported by the frame portion 30 through intermediation of the base-side engaging ring portions 24 and the frame-side engaging ring portions 32, the table surface of the gemstone 10 is oriented obliquely upward, and that, in the side view of the pendant 1, a position of the contact point O of the base-side engaging ring portion 24 and the frame-side engaging ring portion 32 is arranged above a position of a center of gravity of the base portion 20 and the gemstone 10 as a whole. At this time, the base portion 20 is supported by the frame portion 30 in a posture that the central opening portions 24*a* of the base-side engaging ring portions 24 are oriented in the front-and-rear direction.

Further, in Example 1, the base portion 20 is formed such that, for example, when the gemstone 10 is oriented to the front such that the table surface of the gemstone 10 is parallel to the upper-and-lower direction, in the side view of the pendant 1, the position of the center of gravity of the base portion 20 and the gemstone 10 as a whole is arranged on the rear side (backward side) with respect to the position of the contact point O of the base-side engaging ring portion 24 and the frame-side engaging ring portion 32. The right-and-left base-side engaging ring portions 24 are held such that the central opening portions 24*a* thereof are oriented obliquely downward when the gemstone 10 is oriented to the front such that the table surface of the gemstone 10 is parallel to the upper-and-lower direction. Note that, in Example 1, as illustrated in FIG. 3, it is preferred that the base portion 20 be formed such that the table surface of the gemstone 10 is inclined obliquely upward under the state in which the gemstone 10 and the base portion 20 are suspended with respect to the frame portion 30 that is held along a gravity direction. In this case, the base portion 20 is formed such that an inclination angle α of the table surface of the gemstone 10 with respect to the gravity direction is 5° or more and 45° or less, or preferably 10° or more and 20° or less.

As illustrated in FIG. 1, the frame portion 30 of Example 1 includes the frame body portion 31 that is provided as the protective member, the right-and-left frame-side engaging ring portions 32 that are fixed to an inner surface of the frame body portion 31, and a chain link portion 33 (annular hook) that is provided to protrude upward at an upper end portion of the frame body portion 31, and coupled to the chain 5 of the pendant. The chain link portion 33 is fixed to the frame body portion 31, for example, by brazing with laser or the like (welding).

Further, as illustrated in FIG. 1, in the front view of the pendant 1, the frame body portion 31 of Example 1 has a doughnut shape surrounding the base portion 20 and the gemstone 10 as a whole from the outside. In order that the base portion 20 and the gemstone 10 do not come into contact with the frame body portion 31 even when swinging, in the front view of the pendant 1, the frame body portion 31 is spaced apart from the gemstone 10 held by the base portion 20 to the outside. With this, a gap is formed between the gemstone 10 and the frame body portion 31. As illustrated in FIG. 1 and FIG. 2, the frame body portion 31 has the same doughnut-like front-back symmetrical shape whether being viewed from the front side or the rear side.

As illustrated in FIG. 3, in the side view of the pendant 1, the frame body portion 31 of Example 1 has a thickness in the front-and-rear direction at which a back-surface-side distal end portion arranged on a rearmost side of the gemstone 10 (that is, culet portion 11) is located at a position on the front surface side with respect to a position of a back surface of the frame body portion 31. In other words, under the state illustrated in FIG. 3, the back surface of the frame body portion 31 is arranged at a position further on the back side with respect to the position of the culet portion 11 of the gemstone 10 in the front-and-rear direction of the pendant 1. With this, when the pendant 1 of Example 1 is worn as described below (refer to FIG. 7), the gemstone 10 can be held stably at a position on the front surface side of the pendant 1 away from clothes or the like. Thus, the minute swing of the gemstone 10 can be advantageously prevented from being hindered by contact with the clothes or the like.

Figure 5:
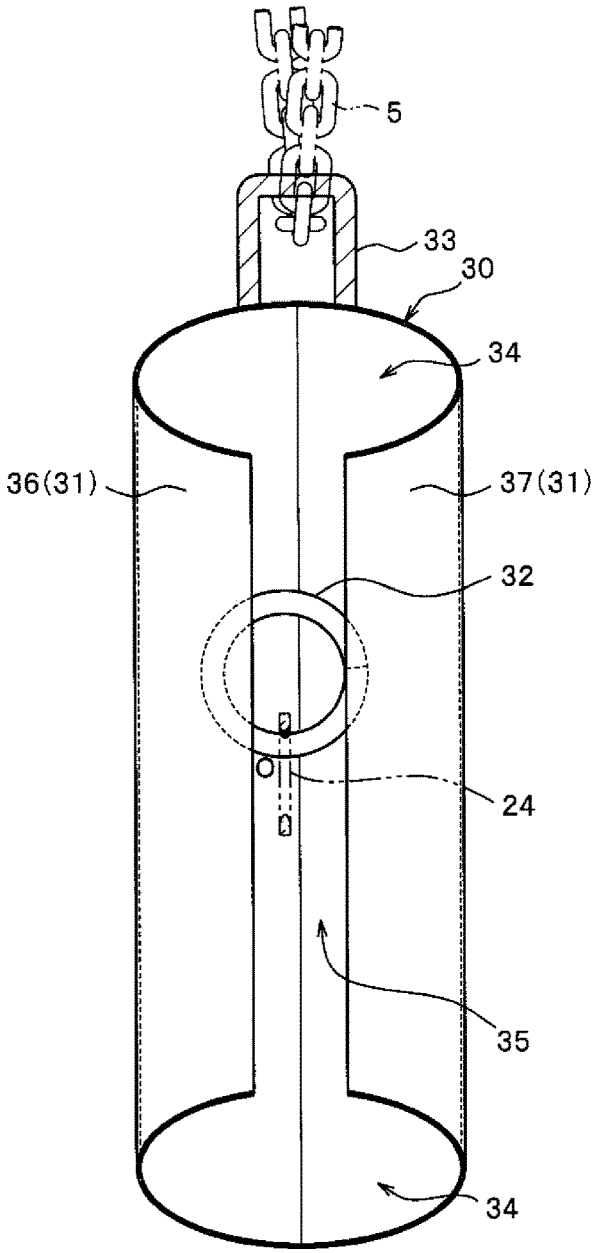
FIG. 5 A cross-sectional view illustrating a frame portion (protective member) that is arranged in the pendant.

FIG. 5 is a cross-sectional view of a central portion in the right-and-left direction of the frame body portion 31, which is taken along a plane orthogonal to the right-and-left direction. As illustrated, for example, in the cross-sectional view of FIG. 5, the frame body portion 31 of Example 1 is formed to have a predetermined thickness. With this, the frame body portion 31 secures an appropriate strength. Further, the frame body portion 31 of Example 1 has a hollow shape, that is, an interior space (housing compartment) 34 is formed in the frame body portion 31.

This frame body portion 31 is not only a component that forms the part of the frame portion 30, but also the protective member that surrounds and protects the frame-side engaging ring portions 32 and the base-side engaging ring portions 24 from the outside. In other words, the protective member that protects the frame-side engaging ring portions 32 and the base-side engaging ring portions 24 is formed as the frame body portion 31 that supports the base portion 20 and the gemstone 10.

The frame body portion (protective member) 31 of Example 1 is formed as a single member capable of protecting, at once, one of the frame-side engaging ring portions 32 and one of the base-side engaging ring portions 24, which are coupled to each other on the left side, and another one of the frame-side engaging ring portions 32 and another one of the base-side engaging ring portions 24, which are coupled to each other on the right.

The interior space 34 of the frame body portion (protective member) 31 is capable of housing the frame-side engaging ring portions 32 and the base-side engaging ring portions 24 under the state in which the frame-side engaging ring portion 32 and the base-side engaging ring portion 24 are engaged with each other on each of the right and left. In addition, the interior space 34 has a size in which the frame-side engaging ring portions 32 and the base-side engaging ring portions 24 do not interfere (not collide) even when the base portion 20 and the gemstone 10 swing. In other words, the interior space 34 of the frame body portion (protective member) 31 is formed as the housing compartment that houses therein the frame-side engaging ring portion 32 and the base-side engaging ring portion 24 in a pair on each of the right and left under the state in which the frame-side engaging ring portion 32 and the base-side engaging ring portion 24 are engaged with each other.

In the frame body portion (protective member) 31 of Example 1, the right-and-left annular frame-side engaging ring portions 32 that are fixed to the inner surface of the frame body portion (protective member) 31, and the right-and-left annular base-side engaging ring portions 24 provided to the base body portion 21 are coupled to each other. In this state, these engaging ring portions 32 and 24 are arranged in the interior space 34 (housing compartment), thereby being housed in the frame body portion (protective member) 31. In this way, the frame body portion (protective member) 31 continuously covers, from the outside, at least a front (front surface), a rear (back surface), an upper surface, a lower surface, and an outer lateral surface in the width direction of each of the frame-side engaging ring portions 32, and at least those of each of the base-side engaging ring portions 24 in the coupled state such that these surfaces are not exposed, thereby protecting the frame-side engaging ring portions 32 and the base-side engaging ring portions 24 overall.

Figure 8:
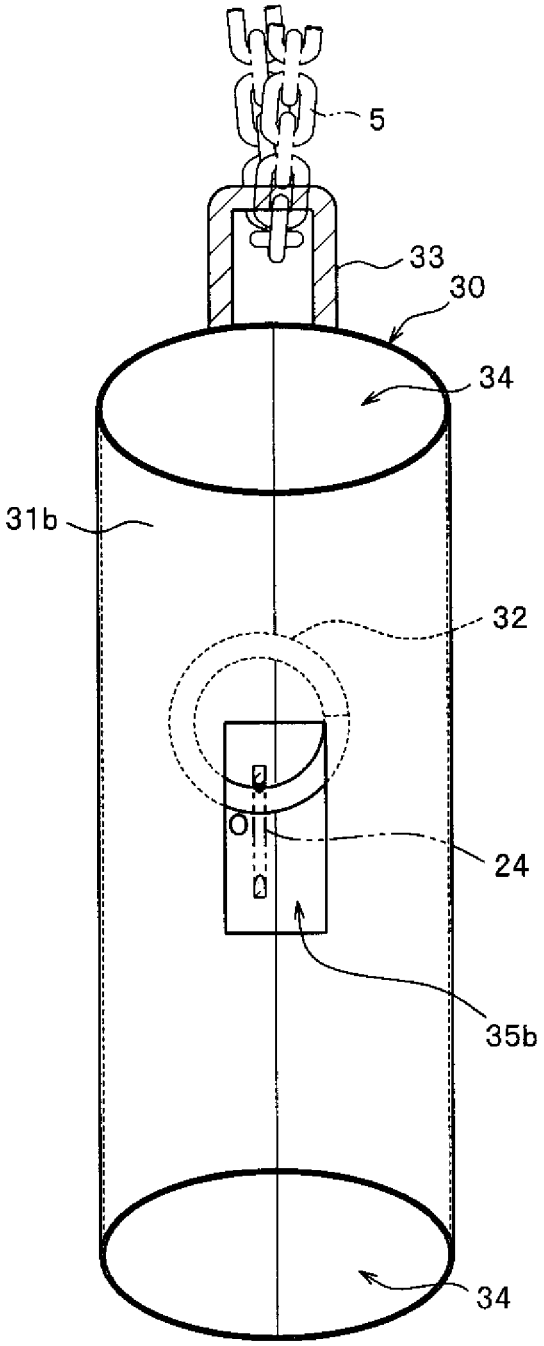
FIG. 8 A cross-sectional view illustrating a frame portion (protective member) of a pendant according to a modification of Example 1.

Further, the frame body portion 31 of Example 1 has, uniformly over its entire circumference, a substantially C-shape elongated in the front-and-rear direction in cross-section orthogonal to its circumferential direction. As illustrated in FIG. 5, an inner peripheral slot 35 opened to the base portion 20 and the gemstone 10 is formed along an inner rim portion of the frame body portion 31. This inner peripheral slot 35 is formed all over the circumferential direction (over entire circumference) of the ring-shaped frame body portion 31 along the inner rim portion of the frame body portion 31. Parts of the inner peripheral slot 35 of the frame body portion 31 serve as insertion opening portions that allow the right-and-left arm portions 23 of the base portion 20 to be inserted therethrough. The frame-side engaging ring portion 32 is fixed in a state of being in contact with a curved part of the inner surface of the frame body portion 31. Note that, in the present invention, for example, the insertion opening portions may be formed to open toward the base portion 20 and the gemstone 10 as an inner peripheral slot **35*b* of a frame body portion 31*b* illustrated as a modification in FIG. 8 is opened such that the right-and-left arm portions 23 can be inserted only within predetermined ranges where the base portion 20 and the gemstone 10** securely swing.

The inner peripheral slot 35 of the frame body portion 31 is formed to have a size (clearance) in which the right-and-left arm portions 23 are not liable to interfere (or do not interfere) even when the base portion 20 and the gemstone 10 swing, for example, in an angular range of approximately 20° in the front-and-rear direction with respect to the frame portion 30 (specifically, even when the base portion 20 and the gemstone 10 under the state of FIG. 3 swing in an angular range of approximately 10° forward and backward each) during normal use of the pendant.

Further, by the size of the inner peripheral slot 35 that is formed in the frame body portion 31, the swing range of the base portion 20 and the gemstone 10 is restricted such that the base portion 20 and the gemstone 10 properly swing at a predetermined angle with respect to the frame portion 30. In other words, when an amount of the swing of the base portion 20 and the gemstone 10 exceeds a certain amount, the base portion 20 and the gemstone 10 abut against the frame body portion 31 (front part 36 or rear part 37 described below), whereby the swing range of the base portion 20 and the gemstone 10 is restricted. With this, the swing range of the base portion 20 and the gemstone 10 can be kept within a range in which the pendant 1 looks beautifully sparkly as viewed from the front. Thus, a decorative effect by the swing of the gemstone 10 can be more advantageously obtained.

In the example of FIG. 5, the inner peripheral slot 35 of the frame body portion 31 is provided such that a center position in the front-and-rear direction of the inner peripheral slot 35 matches a center position in the front-and-rear direction of the frame body portion 31. As other examples of the present invention, the inner peripheral slot 35 may be provided such that the center position in the front-and-rear direction of the inner peripheral slot 35 may be provided to shift forward or backward with respect to the center position in the front-and-rear direction of the frame body portion 31.

The doughnut-shaped frame body portion 31 of Example 1 includes the front part 36 that covers and protects the front sides of the frame-side engaging ring portions 32, and the front sides of the base-side engaging ring portions 24 such that these front sides are not exposed, and the rear part 37 that covers and protects the rear sides of the frame-side engaging ring portions 32, and the rear sides of the base-side engaging ring portions 24 such that these rear sides are not exposed. In Example 1, the front part 36 and the rear part 37 of the frame body portion 31 have front-back symmetrical shapes. Such a front part 36 and a rear part 37 are fixed to each other, for example, by brazing with laser or the like. Note that, in the present invention, means for fixing the front part 36 and the rear part 37 to each other is not particularly limited.

Further, in Example 1, the front part 36 and the rear part 37 of the frame body portion 31 are prepared to have a thickness of, for example, 0.5 mm or less (preferably, 0.1 mm or less) by performing press working (punch press working) or the like on the sheet made of the precious metal such as gold, platinum, or silver.

When the hollow frame-body portion 31 is formed with use of two components of such a front part 36 and a rear part 37, for example, the right-and-left base-side engaging ring portions 24 are respectively joined to and engaged with the right-and-left frame-side engaging ring portions 32, and then the front part 36 and the rear part 37 are fixed by being combined with each other in a manner that the right-and-left frame-side engaging ring portions 32 and the right-and-left base-side engaging ring portions 24 coupled to each other are wrapped. Thus, the frame body portion 31 can be easily assembled, and the right-and-left frame-side engaging ring portions 32 and the right-and-left base-side engaging ring portions 24 can be stably housed within the frame body portion (protective member) 31, specifically, within the above-described housing compartment (interior space 34) of the frame body portion 31.

In Example 1, the front part 36 and the rear part 37 have the front-back symmetrical shapes, and hence the same components having the uniform doughnut shape can be used as the front part 36 and the rear part 37. With this, the front part 36 and the rear part 37 can be prepared at low cost. In addition, the front part 36 and the rear part 37 are not confused with each other. Thus, the operation of combining and fixing the front part 36 and the rear part 37 to each other can be prevented from being complicated, and hence the operation can be efficiently performed.

Note that, in the present invention, shapes and materials of the front part 36 and the rear part 37 of the frame body portion 31 to serve as the protective member are not limited to the shape and the materials in Example 1, and can be arbitrarily changed as described, for example, in Example 2 below.

The right-and-left frame-side engaging ring portions 32 in Example 1 are each formed by cutting a metal linear member having a circular shape in cross-section into a predetermined length, and then by bending this cut linear member into a ring shape. Further, the frame-side engaging ring portions 32 before being coupled to the base-side engaging ring portions 24 each have a jump-ring shape having a gap that allows the base-side engaging ring portion 24 to be inserted thereinto.

When the base-side engaging ring portion 24 is coupled to the frame-side engaging ring portion 32, before the front part 36 and the rear part 37 of the frame body portion 31 are fixed to each other, first, the base-side engaging ring portion 24 is inserted into the gap of the jump-ring-like frame-side engaging ring portion 32 such that the frame-side engaging ring portion 32 is inserted through the central opening portion 24*a* of the base-side engaging ring portion 24, and intersected with the base-side engaging ring portion 24. Then, under the state in which the frame-side engaging ring portion 32 has been inserted through the central opening portion 24*a* of the base-side engaging ring portion 24, both end portions of the frame-side engaging ring portion 32 are fitted and pressed to each other such that the gap is closed. In this way, the frame-side engaging ring portion 32 is plastically deformed (swaged) into the annular shape.

In this way, the right-and-left annular base-side engaging ring portions 24 can be respectively and easily coupled to and engaged with the right-and-left frame-side engaging ring portions 32. At this time, the base-side engaging ring portion 24 and the frame-side engaging ring portion 32 are joined to each other such that the inner rim portions are brought into contact with each other. Further, in Example 1, after the frame-side engaging ring portion 32 is plastically deformed as described above, when necessary, the end portions of the frame-side engaging ring portion 32, which are fitted to each other, may be fixed to each other by brazing or the like.

In addition, the frame-side engaging ring portion 32 of Example 1 is formed into the circular shape in cross-section orthogonal to its circumferential direction. However, in the present invention, the cross-sectional shape of the frame-side engaging ring portion 32 is not particularly limited. As the cross-sectional shape of the frame-side engaging ring portion 32, there may be employed, for example, the tapered shape of the base-side engaging ring portion 24, which is illustrated in FIG. 6, or other shapes.

The right-and-left frame-side engaging ring portions 32 of Example 1 are fixed by brazing with laser or the like at predetermined positions on an inner surface (inner wall surface) of the front part 36 of the frame body portion 31 in a posture parallel to the upper-and-lower direction in the front view (FIG. 1) of the pendant 1 such that the central opening portions of the frame-side engaging ring portions 32 are oriented in the right-and-left direction. The right-and-left frame-side engaging ring portions 32 are fixed to the front part 36 of the frame body portion 31. Thus, the base portion 20 and the gemstone 10 can be held stably at a position closer to the front side of the pendant 1. With this, the gemstone 10 can be made further eye-catching.

Note that, in the present invention, means for fixing the frame-side engaging ring portions 32 to the frame body portion 31 is not particularly limited, and fixing means other than brazing may be employed. Further, although the frame-side engaging ring portions 32 of Example 1 are fixed to the frame body portion 31 in the posture parallel to the upper-and-lower direction as described above, in the present invention, the orientation and the posture of the frame-side engaging ring portions 32 that are fixed to the frame body portion 31 are not particularly limited. In the present invention, for example, as illustrated in a front view (FIG. 10) of a pendant 1*c* of a modification described below, frame-side engaging ring portions 32*c* in a posture inclined with respect to the upper-and-lower direction may be fixed to the frame body portion 31. In addition, although the frame-side engaging ring portions 32 of Example 1 are formed as members separate from the frame body portion 31, and are fixed to the frame body portion 31 with use of the fixing means, in the present invention, the frame-side engaging ring portions 32 and the frame body portion 31 may be formed integrally with each other as a single member.

Further, in the present invention, the right-and-left frame-side engaging ring portions 32 need not necessarily be fixed to the inner surface of the front part 36 of the frame body portion 31, and may be fixed to an inner surface of the rear part 37 of the same. In addition, for example, a size of the frame-side engaging ring portions 32 may be increased such that the frame-side engaging ring portions 32 are fixed to the inner surfaces of both the front part 36 and the rear part 37. Alternatively, for example, protruding piece portions for fixing-position adjustment may be provided to the frame-side engaging ring portions 32 such that the fixing positions with respect to the front part 36 can be adjusted. Further, the operation of coupling the base-side engaging ring portions 24 to the frame-side engaging ring portions 32 as described above may be performed after fixing the frame-side engaging ring portions 32 to the frame body portion 31 (before fixing the front part 36 and the rear part 37 to each other), or may be performed before the frame-side engaging ring portions 32 are fixed to the frame body portion 31.

As described hereinabove, according to the pendant 1 of Example 1, which includes the frame portion 30 including the frame body portion (protective member) 31, and which includes the base portion 20 holding the gemstone 10, the base portion 20 is supported with respect to the frame portion 30 through intermediation of the base-side engaging ring portions 24 and the frame-side engaging ring portions 32.

Figure 7:
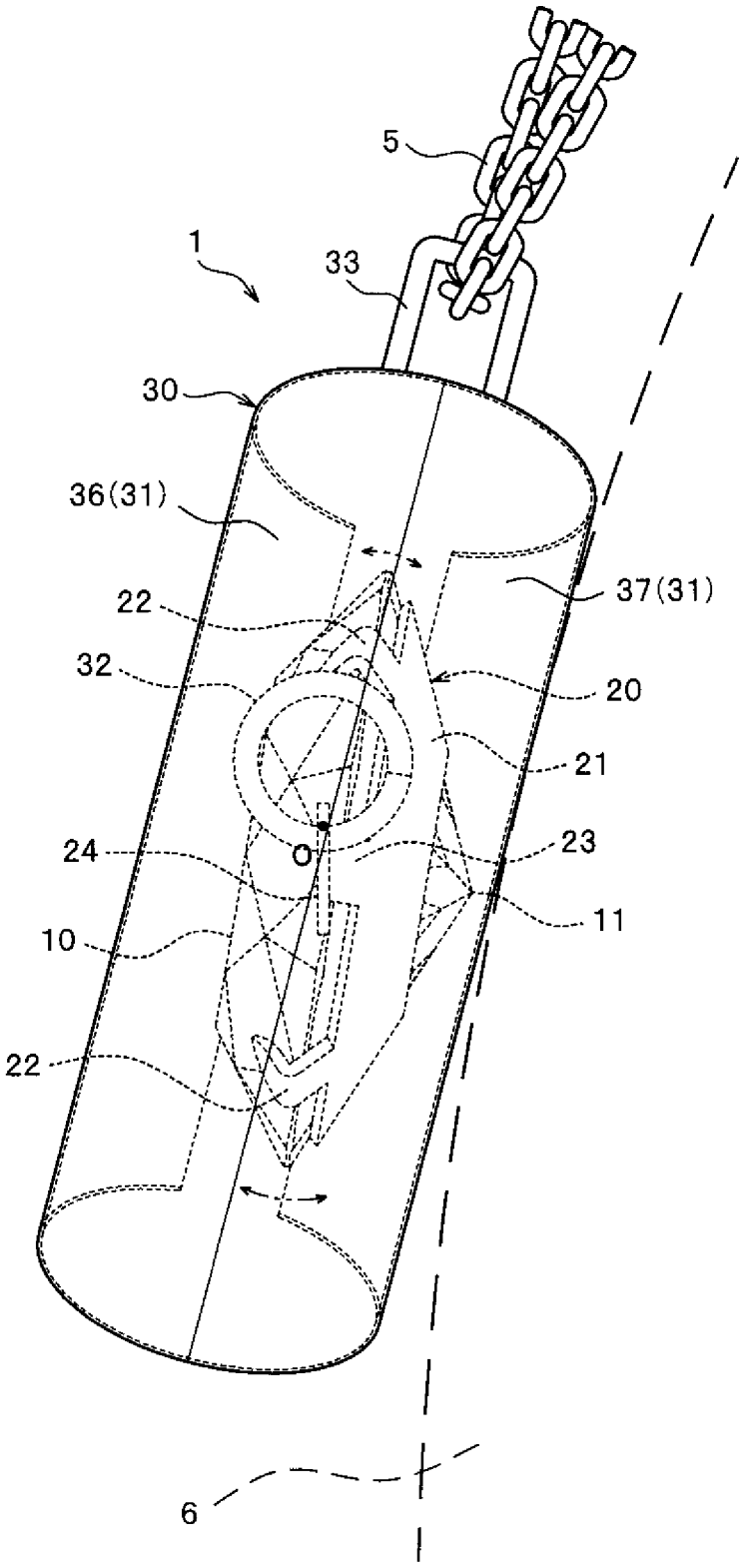
FIG. 7 A schematic view schematically illustrating a state in which the pendant of Example 1 is worn on the chest.

Thus, in a case where a user 6 wears the pendant including this pendant 1 in a manner that the pendant is suspended from his/her neck as illustrated, for example, in FIG. 7, when the pendant 1 is shifted or swung, the base portion 20 and the gemstone 10 can be minutely and continuously swung in the front-and-rear direction in the state of being suspended from the frame portion 30. With this, brilliance of the diamond can be beautifully enhanced. In this case, in the side view of the pendant 1, the base portion 20 and the gemstone 10 minutely swing in the front-and-rear direction with respect to the position of the contact point O of the base-side engaging ring portion 24 and the frame-side engaging ring portion 32. Further, when the base portion 20 and the gemstone 10 swing, the position of the contact point O also may shift back and forth along the inner rim of the frame-side engaging ring portion 32.

In particular, in Example 1, in the front view of the pendant 1, the base portion 20 and the gemstone 10 are swung at substantially a central portion of a circular central-opening portion that is formed in the frame portion 30. Thus, the frame portion 30, which has the simple doughnut shape, looks simple but beautiful. Further, the gemstone 10 looks floating in the air with respect to the frame portion 30, and the swing of the base portion 20 and the gemstone 10 with respect to the frame portion 30 therearound can be advantageously emphasized. With this, brilliance of the gemstone 10 fixed to the base portion 20 can be more beautifully exhibited, and the pendant 1 is enabled to give an unprecedented brand-new image (sense of beauty).

Further, during use of the pendant, the doughnut-shaped frame portion 30 prevents the base portion 20 and the gemstone 10 from coming into direct contact with the clothes, a scarf, or the like that the user 6 wears. Thus, a state in which the base portion 20 and the gemstone 10 are swingable is stably secured. In particular, as described above, the frame body portion 31 of Example 1 is formed to be thick in the front-and-rear direction such that the back surface arranged on a rearmost side of the frame body portion 31 is located further on the backward side (rear side) with respect to the culet portion 11 of the gemstone 10. With this, not only in the state illustrated in FIG. 3, but also in the state illustrated in FIG. 7, the culet portion 11 of the gemstone 10 does not protrude further to the backward side with respect to the back surface of the frame body portion 31. The gemstone 10 is held at a position away from the clothes, the scarf, or the like that the user 6 wears to the front surface side of the pendant 1. Thus, when the base portion 20 and the gemstone 10 swing within the swing range in the inner peripheral slot 35 of the frame body portion 31, the minute swing of the base portion 20 and the gemstone 10 can be advantageously prevented from being hindered by the contact with the clothes, the scarf, or the like. With this, the swing of the base portion 20 and the gemstone 10 can be stably continued.

Further, in Example 1, not only when the frame body portion 31 is held along a vertical direction as illustrated, for example, in FIG. 3, but also when the frame body portion 31 is held with a slight inclination with respect to the vertical direction on the chest of the user 6 as illustrated, for example, in FIG. 7, the gemstone 10 and the base portion 20 are supported by the frame portion 30 such that the table surface of the gemstone 10 is oriented obliquely upward. Thus, the pendant 1 of Example 1 is capable of more advantageously enhancing the brilliance of the gemstone 10 on the chest of the user 6 wearing the pendant such that the table surface of the gemstone 10 is likely to catch eyes of others.

Further, in the pendant 1 of Example 1, the right-and-left frame-side engaging ring portions 32 and the right-and-left base-side engaging ring portions 24 are formed delicately and in a small size, and hence have properties of being vulnerable to deformation. However, entireties of the right-and-left frame-side engaging ring portions 32, and entireties of the right-and-left base-side engaging ring portions 24 are covered with and protected by the frame body portion 31 to serve as the protective member (in other words, entireties of the right-and-left frame-side engaging ring portions 32, and entireties of the right-and-left base-side engaging ring portions 24 are protected by being housed in the housing compartment (interior space 34) of the frame body portion 31). With this, the base-side engaging ring portions 24 and the frame-side engaging ring portions 32 are not exposed to the outside. Thus, during the normal use as the pendant, the base-side engaging ring portions 24 and the frame-side engaging ring portions 32 can be prevented from colliding directly against or forcefully pressed by accident directly onto other objects.

In this way, in the pendant 1 of Example 1, the base-side engaging ring portions 24 and the frame-side engaging ring portions 32 do not directly receive unexpected external force (load) from the outside. Thus, the base-side engaging ring portions 24 and the frame-side engaging ring portions 32 can be advantageously prevented from being deformed or damaged by such external force. As a result, the state in which the gemstone 10 is minutely and smoothly swingable can be stably maintained for a long duration.

Further, when the base-side engaging ring portions 24 and the frame-side engaging ring portions 32 are protected by the frame body portion (protective member) 31, hair strands, threads, and the like are prevented from being entangled in the base-side engaging ring portions 24 and the frame-side engaging ring portions 32. With this, handling properties of the pendant can be increased, and the minute swing of the gemstone 10 can be prevented from being hindered by the entanglement of the threads and the like.

In particular, in Example 1, the base-side engaging ring portions 24 and the frame-side engaging ring portions 32 are covered with the frame body portion 31, and hence are invisible from the outside. Thus, for example, the frame-side engaging ring portions 32 may be further increased in diameter without degrading quality of an external appearance of the pendant 1. With this, for example, a bonding strength of the frame-side engaging ring portions 32 with respect to the frame body portion 31 can be increased, and durability of the pendant 1 can be increased.

In addition, in Example 1, the base-side engaging ring portions 24 and the frame-side engaging ring portions 32 are made invisible by being covered with the protective member (frame body portion 31), and the protective member that covers and protects them is formed as the precious-metal frame body portion 31 of the frame portion 30. With this, despite additional provision of a member for protecting the ring portions in Example 1, which is not provided to related-art pendants, a feel of an entirety of the pendant 1 is enhanced. As a result, the quality of the external appearance can be enhanced. Further, the frame body portion 31 to serve as the protective member is formed to be thin and into the hollow shape as described above. Thus, an amount of a raw material to be used for the frame body portion 31 can be reduced. As a result, manufacturing cost of the frame portion 30 can be significantly reduced. In particular, in the case of Example 1, manufacturing cost of the frame body portion 31 can be reduced to half or less than that, for example, in a case where the frame body portion is formed to be solid.

Further, since the base-side engaging ring portions 24 and the frame-side engaging ring portions 32 are covered with the frame body portion (protective member) 31, influence of the provision of the base-side engaging ring portions 24 and the frame-side engaging ring portions 32 on design of the pendant 1 is reduced. Thus, a degree of freedom in the design can be increased. Further, the frame body portion (protective member) 31 may be variously designed.

Figure 9:
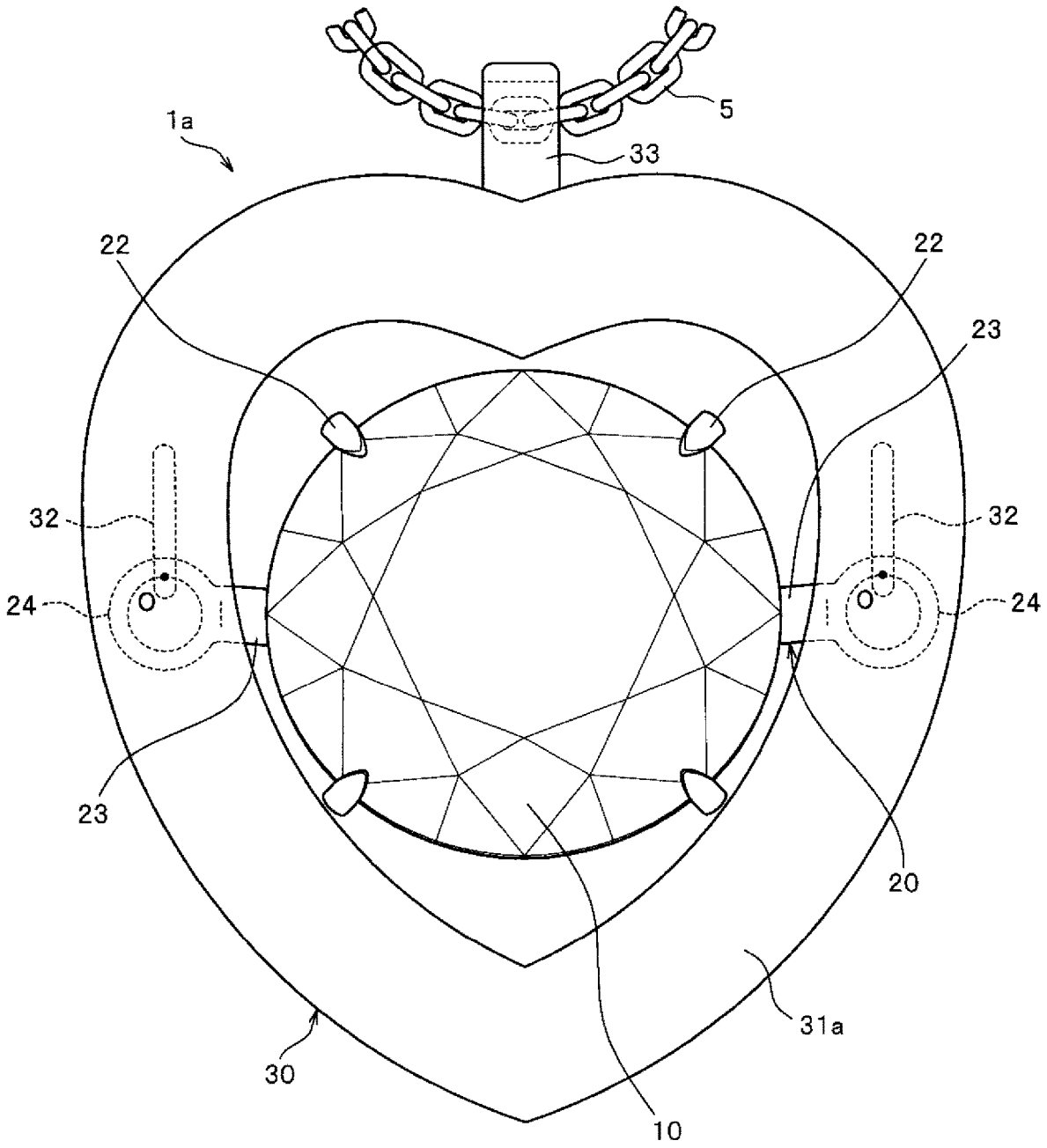
FIG. 9 A front view illustrating a pendant according to another modification of Example 1.

Thus, the frame body portion (protective member) may be formed not only into, for example, a heart frame shape similar to a frame body portion (protective member) 31*a* of a pendant 1*a* of a modification illustrated in FIG. 9, but also into other arbitrary shapes different from that in Example 1, such as a rhombic shape, other frame-like shapes, and shapes like flowers or animals. In this case, for example, a size and the thickness of the frame body portion (protective member), and the size of the frame-side engaging ring portions can be arbitrarily changed.

As a result, the pendant is enabled to give, for example, a pendanting impression or a sophisticated impression, whereby value to be added to the pendant can be further enhanced. Note that, in the pendant 1*a* of FIG. 9, shapes of portions other than the frame body portion (protective member) 31*a* are formed similar to those in the pendant 1 of Example 1 described above. Thus, in FIG. 9 and FIG. 10 according to the other modification described below, parts or members having the same configurations as those in Example 1 described above are denoted by the same reference symbols.

As in Example 1 described above, the entireties of the right-and-left frame-side engaging ring portions 32 of the frame portion 30, and the entireties of the right-and-left base-side engaging ring portions 24 of the base portion 20 are protected by being covered with the frame body portion 31 to serve as the protective member. However, in the present invention, it is only necessary that at least the entireties of the right-and-left frame-side engaging ring portions 32 of the frame portion 30, and coupling parts of the right-and-left base-side engaging ring portions 24 with respect to the frame-side engaging ring portions 32 are protected by the frame body portion 31.

The coupling parts of the base-side engaging ring portions 24 with respect to the frame-side engaging ring portions 32 refer to circular-arc parts of the base-side engaging ring portions 24, which are coupled to and held in contact with the frame-side engaging ring portions 32. These coupling parts include ranges (regions) with which the inner rim portions of the frame-side engaging ring portions 32 are held in sliding contact when the gemstone 10 is minutely swung. In other words, in the base-side engaging ring portions 24, the circular-arc parts of the base-side engaging ring portions 24 include the coupling parts that are held in sliding contact with the inner rim portions of the frame-side engaging ring portions 32 when the circular-arc parts of the base-side engaging ring portions 24 are coupled to the frame-side engaging ring portions 32.

Figure 10:
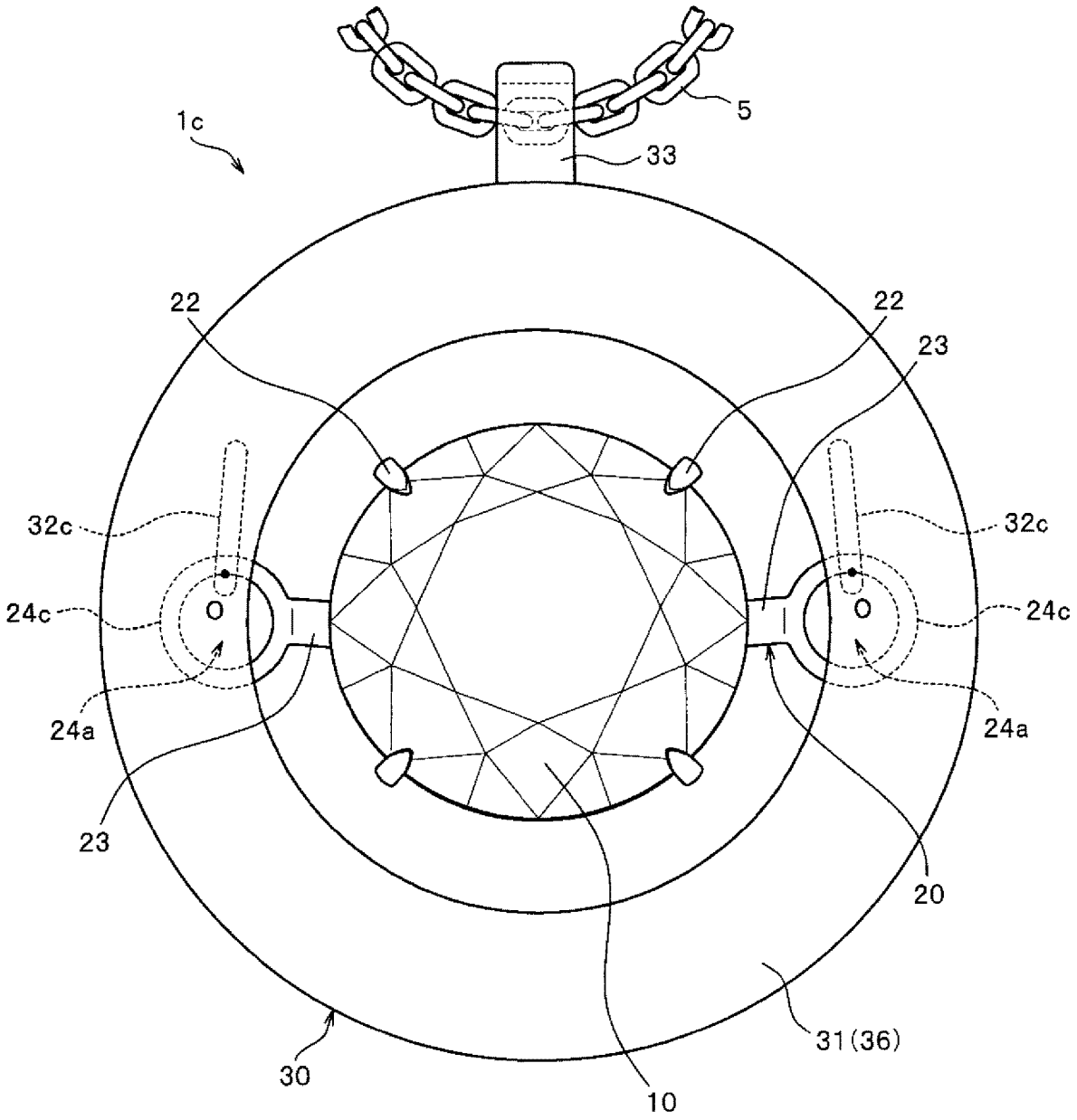
FIG. 10 A front view illustrating a pendant according to still another modification of Example 1.

For example, in the pendant 1*c* of the other modification of Example 1, which is illustrated in FIG. 10, right-and-left base-side engaging ring portions 24*c* are formed to be larger than those of Example 1 described above, and ring parts out of the coupling parts of the right-and-left base-side engaging ring portions 24*c* with respect to the frame-side engaging ring portions 32*c* are partially exposed. Further, at the same time, entireties of the frame-side engaging ring portions 32*c* and at least the coupling parts of the base-side engaging ring portions 24*c* are protected by being covered with the frame body portion 31.

Also in such a pendant 1*c* according to the modification, the base-side engaging ring portions 24*c* and the frame-side engaging ring portions 32*c* can be prevented from being deformed or damaged by the unexpected external force (load) from the outside, and the state in which the gemstone 10 is minutely swingable can be stably maintained for a long duration. Further, hair strands, threads, and the like are prevented from being entangled in the base-side engaging ring portions 24*c* and the frame-side engaging ring portions 32*c*.

Example 2

Figure 11:
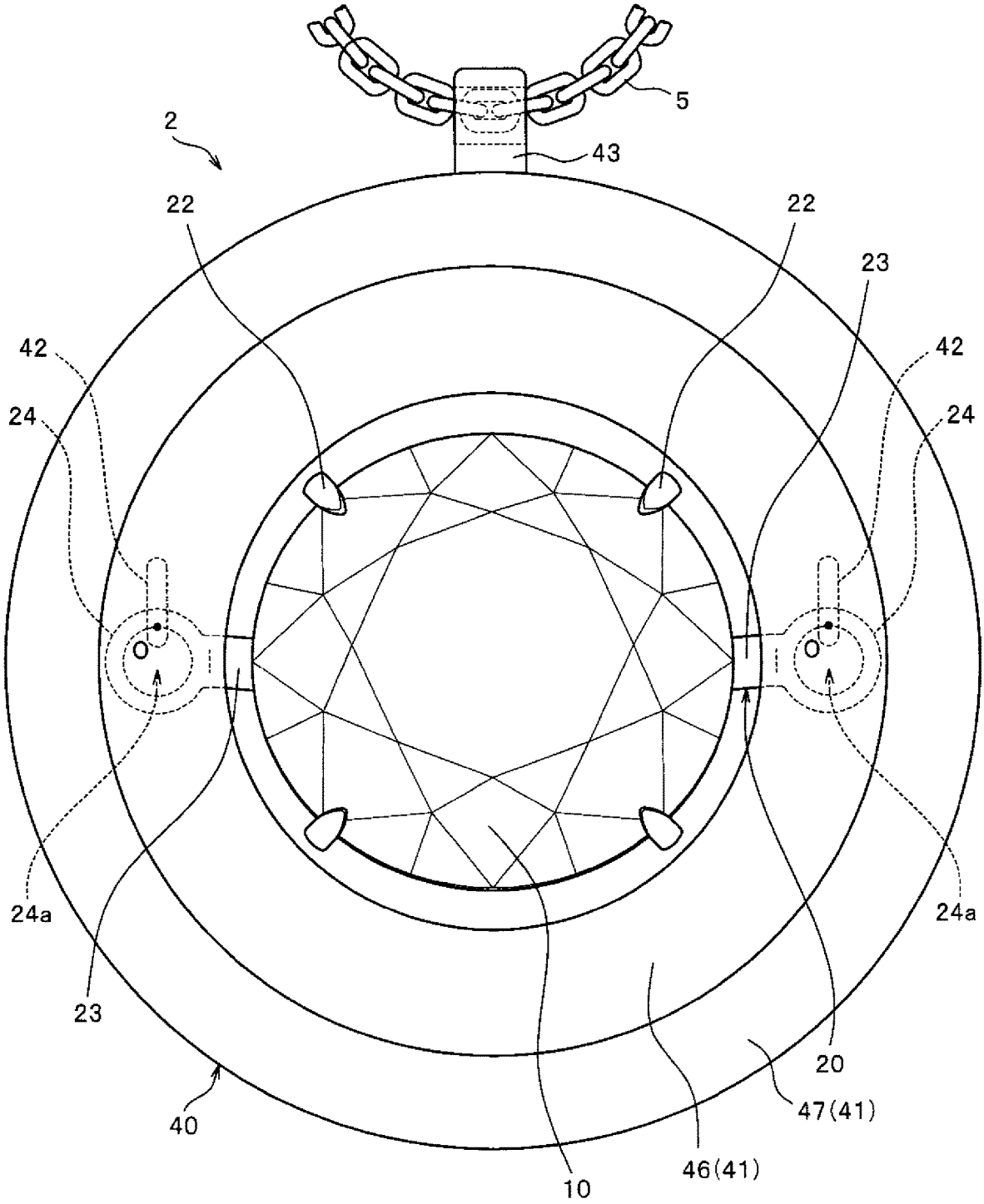
FIG. 11 A front view illustrating a pendant according to Example 2 of the present invention.
Figure 12:
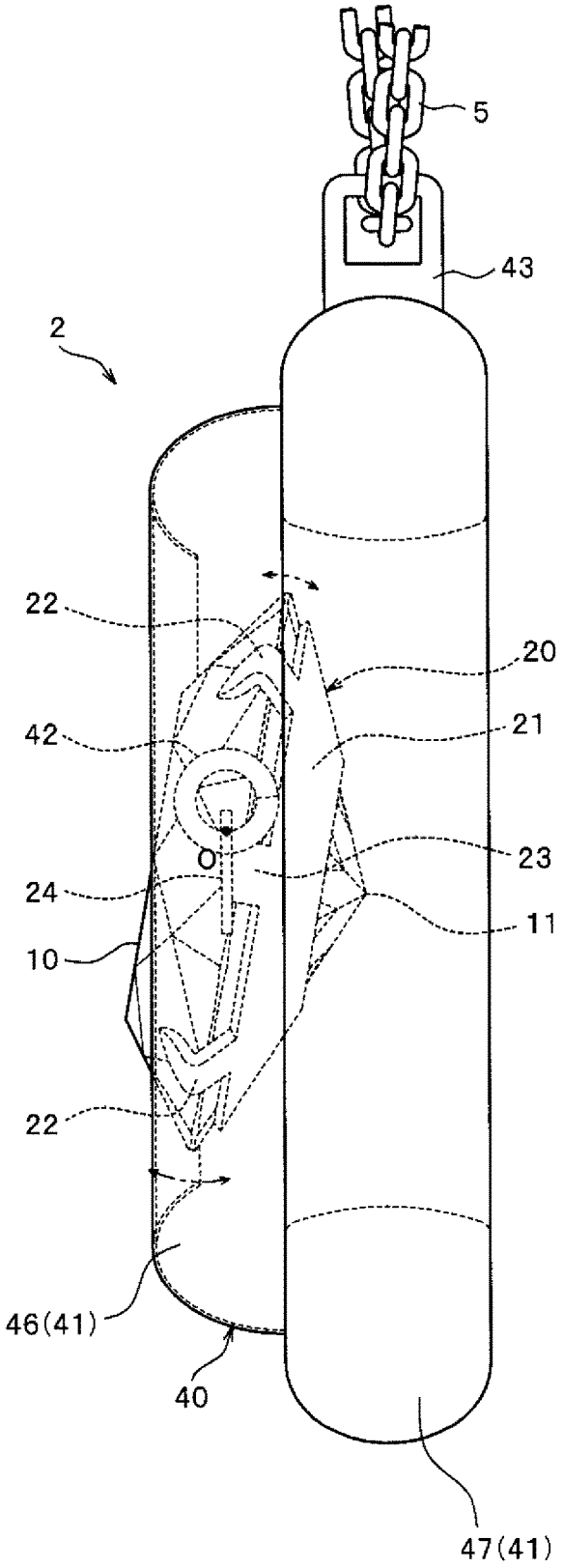
FIG. 12 A side view of the pendant.

FIG. 11 is a front view illustrating a pendant according to Example 2. FIG. 12 is a side view of the pendant.

A pendant 2 according to Example 2 includes the base portion 20 by which the gemstone (diamond) 10 is fixed and held, and a frame portion 40 that supports the base portion 20 and the gemstone (diamond) 10 and is formed as the protective member.

The pendant 2 of Example 2 is different from the pendant 1 of Example 1 described above, for example, in shape of the frame portion 40, but the base portion 20 and the gemstone 10 are formed similar to those in the case of the pendant 1 of Example 1 described above. Thus, not only in description and drawings relating to Example 2, but also in description and drawings relating to Example 3 and Example 4 described below, parts or members having substantially the same configurations as those of the pendant 1 of Example 1 described above are denoted by the same reference symbols, and detailed description thereof is omitted.

In the front view of the pendant 2, the frame portion 40 of Example 2 includes a frame body portion 41 that is arranged to surround the base portion 20 and the gemstone 10 and is provided as the protective member, right-and-left frame-side engaging ring portions 42 that are fixed to an inner surface of the frame body portion 41, and a chain link portion 43 that is provided to protrude upward at an upper end portion of the frame body portion 41.

The chain link portion 43 is attached to the frame body portion 41 by forming a small attachment hole (not shown) in the frame body portion 41 (specifically, rear part 47 of the frame body portion 41), and inserting and fixing a fastener (not shown) of the chain link portion 43 into this attachment hole. Note that, in the present invention, methods of and means for attaching the chain link portion 43 to the frame body portion 41 are not particularly limited.

In the front view of the pendant 2, the frame body portion 41 of Example 2 has a doughnut shape surrounding the base portion 20 and the gemstone 10 as a whole from the outside. In order that the base portion 20 and the gemstone 10 do not come into contact with the frame body portion 41 even when swinging, in the front view of the pendant 2, the frame body portion 41 is spaced apart from the base portion 20 and the gemstone 10 to the outside. With this, a gap is formed between the gemstone 10 and the frame body portion 41.

This frame body portion 41 includes a front part 46 that covers and protects front sides of the frame-side engaging ring portions 42 and the front sides of the base-side engaging ring portions 24 such that these front sides are not exposed, and the rear part 47 that covers and protects rear sides of the frame-side engaging ring portions 42 and the rear sides of the base-side engaging ring portions 24 such that these rear sides are not exposed. The front part 46 of the frame body portion 41 has substantially the same shape as that of the front part 36 of the frame body portion 31 that is used in Example 1 described above, and is formed to be smaller in size overall than the front part 36. The right-and-left frame-side engaging ring portions 42 are each formed into a ring shape smaller in size than the frame-side engaging ring portion 32 that is used in Example 1 described above.

Unlike Example 1 described above, the rear part 47 of Example 2 does not have a front-back symmetrical shape with respect to the front part 46, and is formed of a ceramic member having a doughnut shape. A circular central-opening portion is formed in the front-and-rear direction through a central part in the front view of the rear part 47 of Example 2.

In the front view of the frame body portion 41, a size of an inner diameter of the rear part 47 (size of a diameter of the central opening portion of the rear part 47) is set smaller than a size of an outer diameter of the front part 46, and set to a size capable of protecting the rear sides of the base-side engaging ring portions 24 and the frame-side engaging ring portions 42. The rear part 47 is fixed to the front part 46 by brazing with laser or the like, or by other bonding means.

Note that, in the present invention, the shapes of the front part 46 and the rear part 47 can be arbitrarily changed. For example, in Example 2, as a modification of the rear part 47, there may be used a ceramic member with the circular central-opening portion being not provided therethrough. In this case, a back-wall portion that is arranged to close the central opening portion at a position that corresponds to a rear-side end portion of the rear part, the base portion 20 and the gemstone 10 to swing back and forth being not interfered with at the position, is formed integrally with the rear part according to this modification.

The frame body portion 41 of Example 2 has a hollow shape in which an interior space capable of housing the frame-side engaging ring portions 42 and the base-side engaging ring portions 24 under the state in which the frame-side engaging ring portion 42 and the base-side engaging ring portion 24 are engaged with each other on each of the right and left is formed between the front part 46 and the rear part 47. Thus, this frame body portion 41 is not only a component that forms a part of the frame portion 40, but also the protective member that surrounds and protects the frame-side engaging ring portions 42 and the base-side engaging ring portions 24 from the outside. In other words, in Example 2, as in the case of Example 1 described above, the interior space of the frame body portion (protective member) 41 is formed as the housing compartment that houses therein the frame-side engaging ring portions 42 and the base-side engaging ring portions 24 in the state of being engaged with each other.

In the frame body portion (protective member) 41 of Example 2, the right-and-left annular frame-side engaging ring portions 42 that are fixed to the inner surface of the frame body portion (protective member) 41, and the right-and-left annular base-side engaging ring portions 24 provided to the base body portion 21 are coupled to each other. In this state, these engaging ring portions 42 and 24 are arranged in the above-described housing compartment, thereby being housed in the frame body portion (protective member) 41. In this way, the frame body portion (protective member) 41 continuously covers, from the outside, at least the front (front surface), the rear (back surface), an upper surface, a lower surface, and an outer lateral surface in the width direction of each of the frame-side engaging ring portions 42, and at least those of each of the base-side engaging ring portions 24 in the coupled state such that these surfaces are not exposed, thereby protecting the frame-side engaging ring portions 42 and the base-side engaging ring portions 24 overall.

In other words, since the frame body portion (protective member) 41 of Example 2 houses the frame-side engaging ring portions 42 and the base-side engaging ring portions 24 in the coupled state in the above-described housing compartment of the frame body portion 41 without uncoupling these engaging ring portions 42 and 24 from each other. With this, these engaging ring portions 42 and 24 can be protected by being covered at least from their front (front surface) sides, rear (back surface) sides, upper surface sides, lower surface sides, and outer-lateral-surface sides in the width direction. Further, along an inner rim portion of the frame body portion 41, an inner peripheral slot (insertion opening portion) that allows the right-and-left arm portions 23 of the base portion 20 to be inserted therethrough is formed between the front part 46 and the rear part 47.

The right-and-left frame-side engaging ring portions 42 of Example 2 are formed similar to those in the case of Example 1 described above, and fixed at predetermined positions on an inner surface of the front part 46 of the frame body portion 41 by brazing with laser or the like.

In the pendant 2 as described above in Example 2, although the shape and the material of the frame body portion 41 to serve as the protective member are different from those in the pendant 1 of Example 1 described above, the same advantages as those in the case of Example 1 described above that the state in which the gemstone 10 is minutely and smoothly swingable can be stably maintained for a long duration, and that the minute swing of the diamond can be prevented from being hindered by the entanglement of the threads and the like can be obtained.

Example 3

Figure 13:
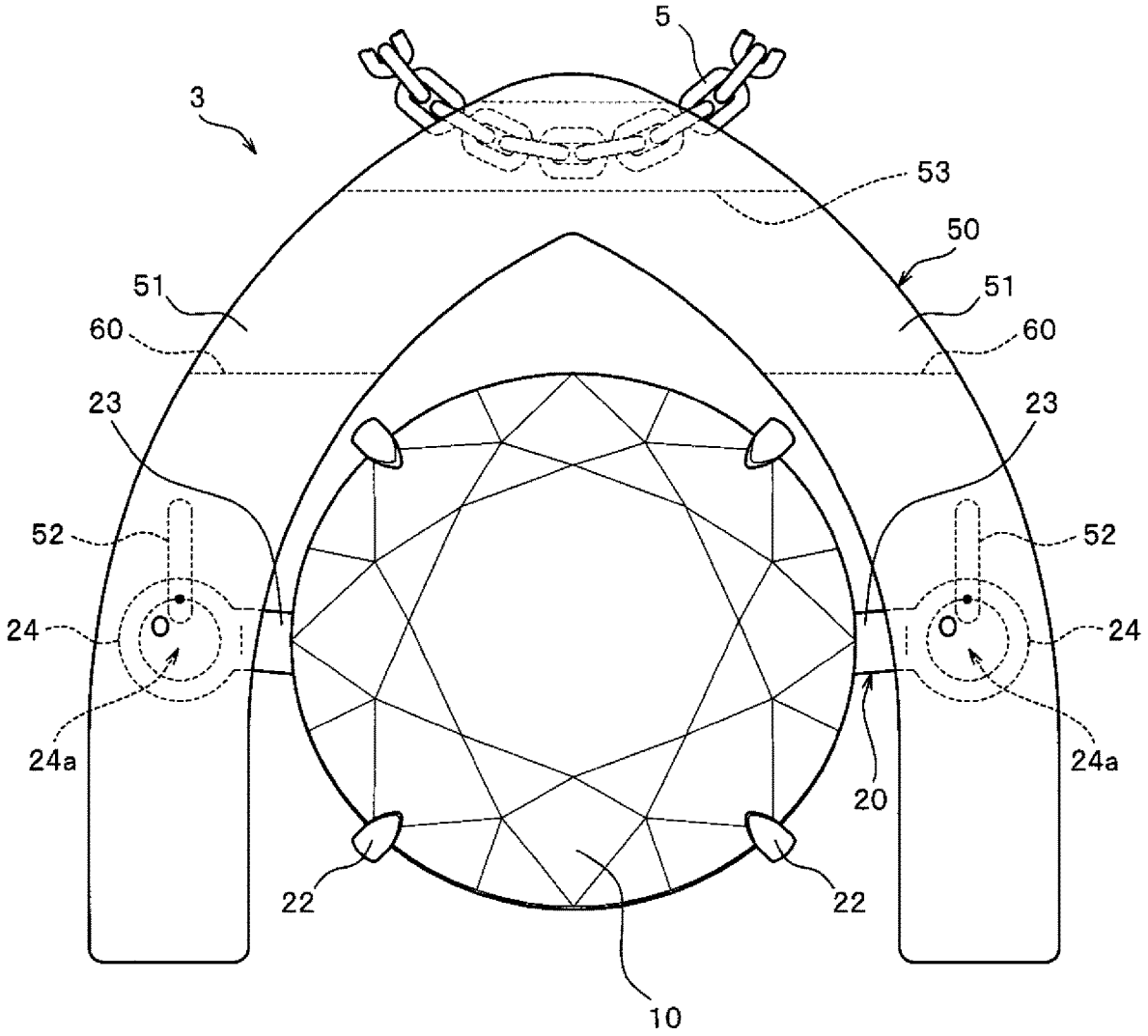
FIG. 13 A front view illustrating a pendant according to Example 3 of the present invention.
Figure 14:
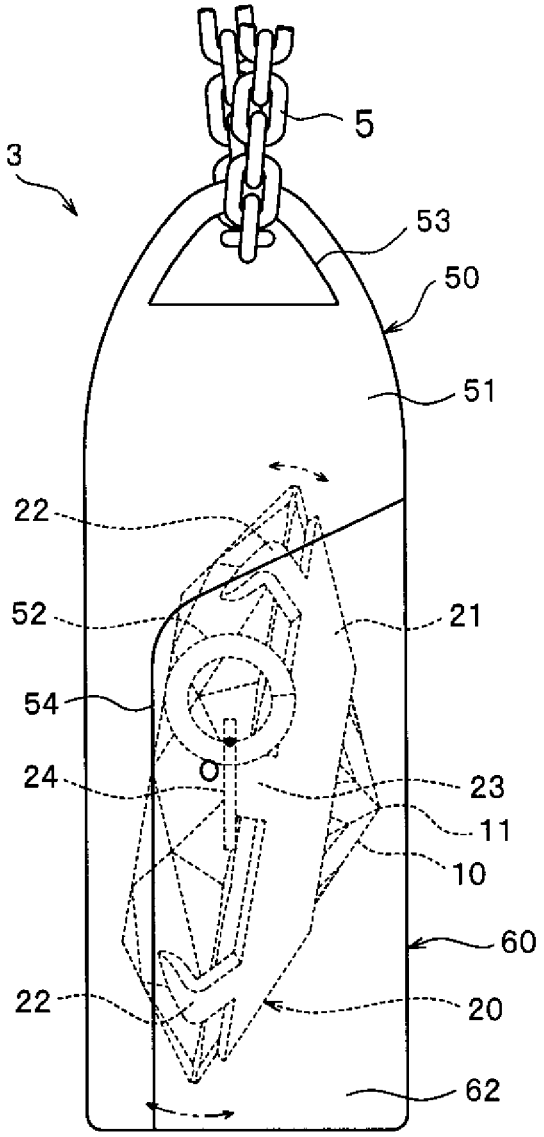
FIG. 14 A side view of the pendant.
Figure 15:
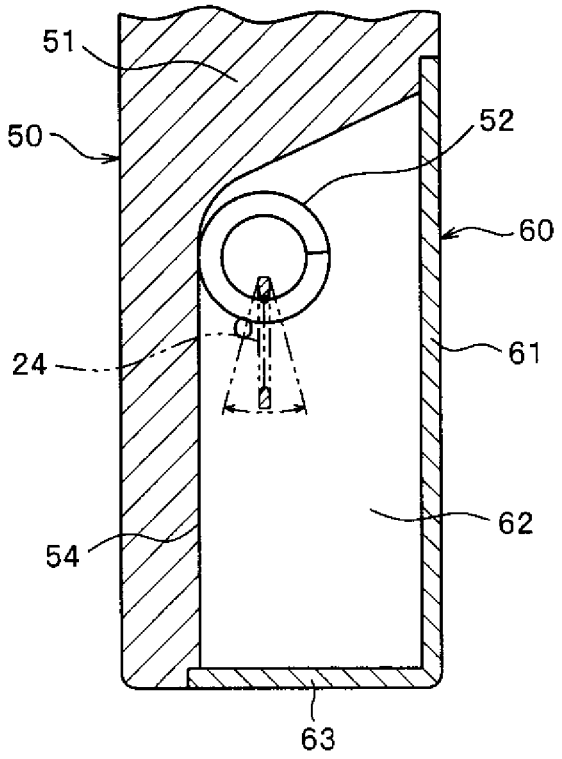
FIG. 15 An enlarged schematic view of a part where a protective member is fixed to a frame portion of the pendant as viewed from an inside in a width direction.

FIG. 13 is a front view illustrating a pendant according to Example 3. FIG. 14 is a side view of the pendant. FIG. 15 is an enlarged view illustrating, on an enlarged scale, a state in which a protective member is fixed to a frame portion of the pendant.

A pendant 3 according to Example 3 includes the base portion 20 by which the gemstone (diamond) 10 is fixed and held, and a frame portion 50 that supports the base portion 20 and the gemstone (diamond) 10. The frame portion 50 of Example 3 includes a frame body portion 51 that has an inverted V-shape in the front view of the pendant 3, right-and-left frame-side engaging ring portions 52 that are provided on back surfaces of right-and-left lower end portions of the frame body portion 51, and a pair of right-and-left protective members 60 that are fixed respectively to rear sides of the right-and-left lower end portions of the frame body portion 51.

That is, in Example 3, the frame body portion 51 and the protective members 60 are formed separately from each other, and the protective members 60 themselves are not formed (do not function) as members that directly support the base portion 20 and the gemstone 10. Meanwhile, the base portion 20 and the gemstone 10 are formed similar to those in the case of the pendant 1 of Example 1 described above.

In the frame portion 50 of Example 3, a chain-link hole portion 53 for coupling the chain 5 of the pendant is provided in the right-and-left direction through an upper end portion of the frame body portion 51. Further, in the front view of the pendant 3, the right-and-left lower end portions of the frame body portion 51 are formed to extend further downward with respect to a lower end position of the base portion 20 and the gemstone 10. By forming the right-and-left lower end portions of the frame body portion 51 in this way, under a state in which the pendant 3 of Example 3 is worn, the clothes or the like that the user wears can be prevented from coming into contact with the gemstone 10 and the base portion 20 from a lower side of the pendant 3.

Right-and-left ring housing portions 54 that house the frame-side engaging ring portions 52 are provided on the rears (back surfaces) of the right-and-left lower end portions of the frame body portion 51 of Example 3. These ring housing portions 54 are each formed by partially reducing a thickness in the front-and-rear direction of the frame body portion 51. The frame-side engaging ring portions 52 are formed integrally and respectively with rears of the right-and-left ring housing portions 54. Note that, in Example 3, the frame-side engaging ring portions 52 may be formed separately from the frame body portion 51, and then fixed at predetermined positions in the frame body portion 51 by brazing or the like.

The right-and-left protective members 60 of Example 3 are formed as members separate from each other. Further, the right-and-left protective members 60 are fixed by brazing or the like to the right-and-left lower end portions of the frame body portion 51 such that the frame-side engaging ring portions 52 and the base-side engaging ring portions 24 in the coupled state are covered from the outside. The protective members 60 each include a back-wall portion 61 that covers a rear side of the frame-side engaging ring portion 52 and that of the base-side engaging ring portion 24, an outer-lateral-wall portion 62 that covers an outer lateral side in the right-and-left direction of the frame-side engaging ring portion 52 and that of the base-side engaging ring portion 24, and a bottom wall portion 63 that covers a lower side of the frame-side engaging ring portion 52 and that of the base-side engaging ring portion 24. Along inner surface portions of the right-and-left lower end portions of the frame portion 50, the inner peripheral slots (insertion opening portions) that allow the right-and-left arm portions 23 of the base portion 20 to be inserted therethrough are formed between the right-and-left lower end portions of the frame body portion 51 and the protective members 60.

According to such a pendant 3 of Example 3, a front side and an upper surface side of each of the frame-side engaging ring portions 52, and those of each of the base-side engaging ring portions 24 in the coupled state are protected by being covered with the frame body portion 51 (front part). In addition, the rear sides, the outer-lateral-surface sides, and the lower surface sides of the frame-side engaging ring portions 52, and those of each of the base-side engaging ring portions 24 in the coupled state are protected by being covered with the protective members 60 (rear parts). In other words, in Example 3, in the frame portion 50, interior spaces that are formed in a manner of being sandwiched between the right-and-left lower end portions of the frame body portion 51 (front part) and the protective members 60 (rear parts) are formed as the housing compartments that house therein and protect the frame-side engaging ring portions 52 and the base-side engaging ring portions 24 in the state of being engaged with each other.

With this, in the pendant 3 of Example 3, during normal use as the pendant, the same advantages as those in Example 1 described above that the state in which the gemstone 10 is minutely and smoothly swingable can be stably maintained for a long duration, and that the minute swing of the gemstone 10 can be prevented from being hindered by the entanglement of the threads and the like can be obtained.

Further, in the side view of the pendant 3, the frame body portion 51 and the right-and-left protective members 60 of Example 3 are formed such that the culet portion 11 of the gemstone 10 are located at a position on the front surface side with respect to positions of the back surfaces of the frame body portion 51 and with respect to positions of back surfaces of the protective members 60. In other words, under the state illustrated in FIG. 14, the back surfaces of the frame body portion 51 and the back surfaces of the right-and-left protective members 60 are arranged at positions further on the back side with respect to the position of the culet portion 11 of the gemstone 10 in the front-and-rear direction of the pendant 3. With this, when the pendant 3 of Example 3 is worn, the gemstone 10 can be prevented from coming into contact with the clothes, the scarf, or the like that the user wears. Thus, the minute swing of the base portion 20 and the gemstone 10 can be advantageously prevented from being hindered by the clothes, the scarf, or the like.

Example 4

Figure 16:
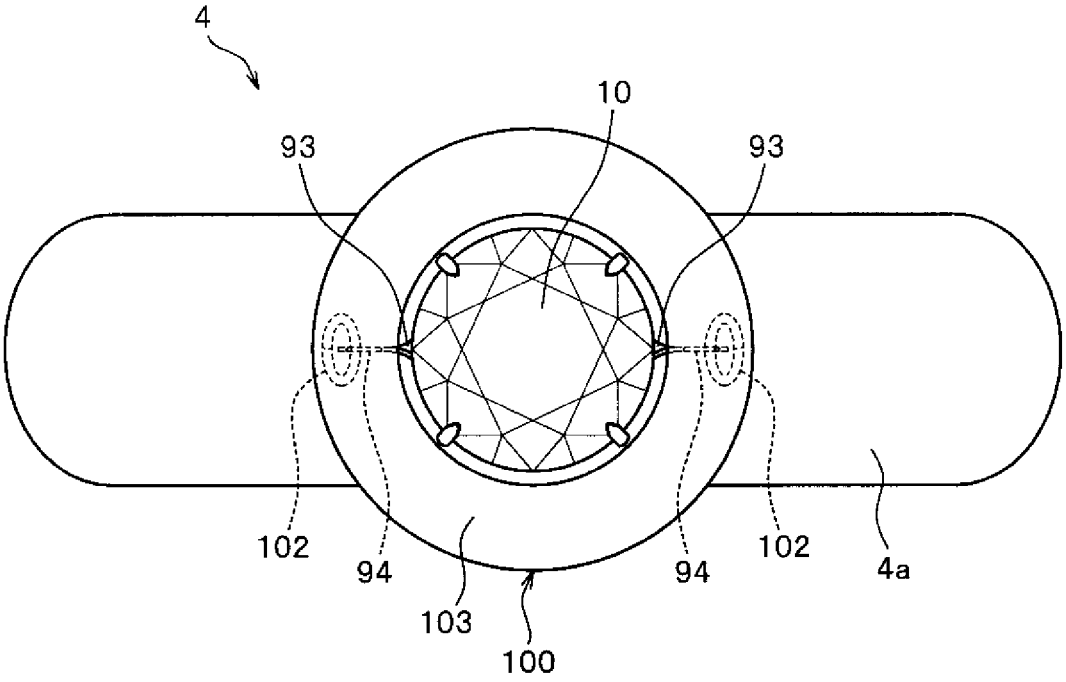
FIG. 16 A front view illustrating a ring according to Example 4 of the present invention.
Figure 17:
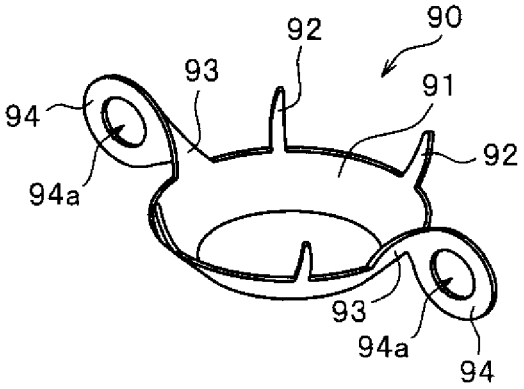
FIG. 17 A schematic perspective view illustrating a base portion to be used in the ring.
Figure 18:
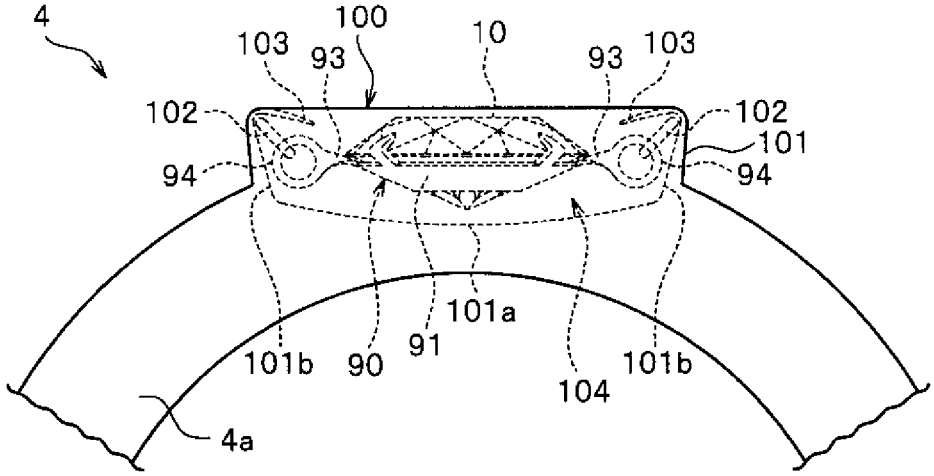
FIG. 18 A schematic view schematically illustrating a main part of the ring.
Figure 19:
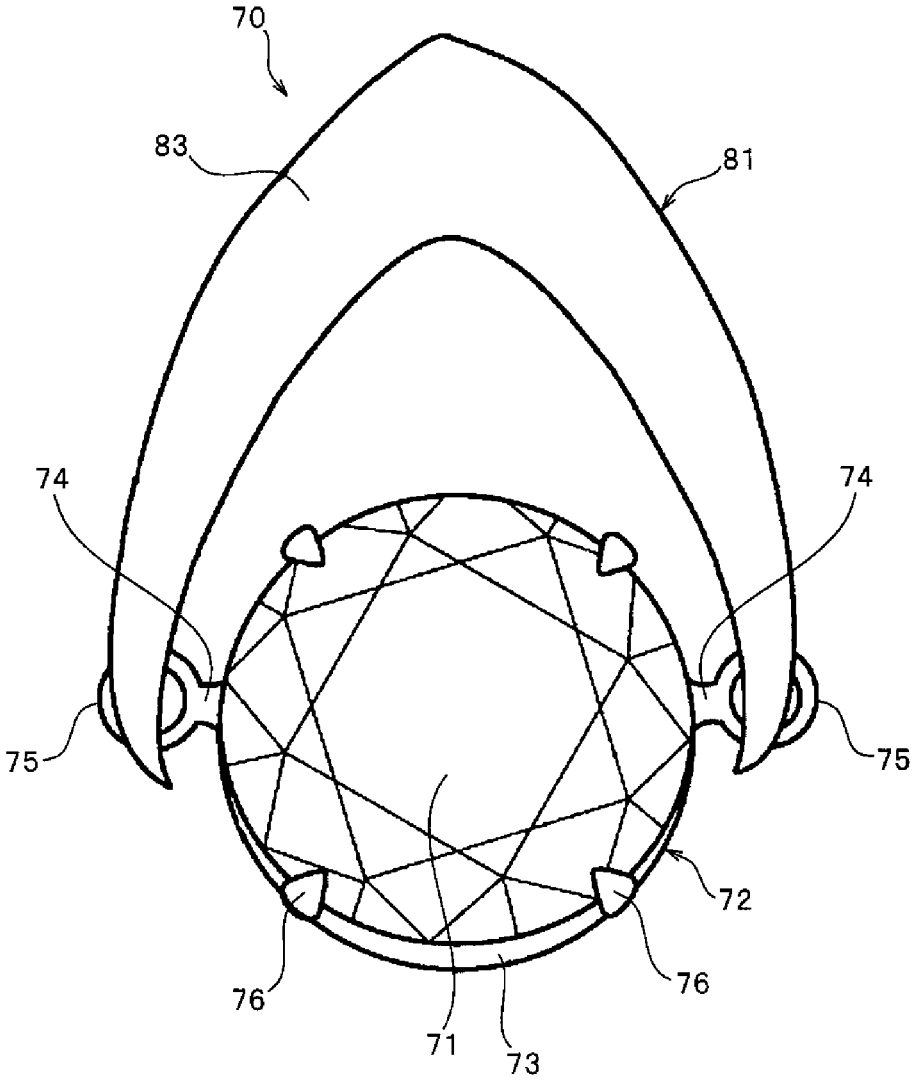
FIG. 19 A front view of a related-art pendant.
Figure 20:
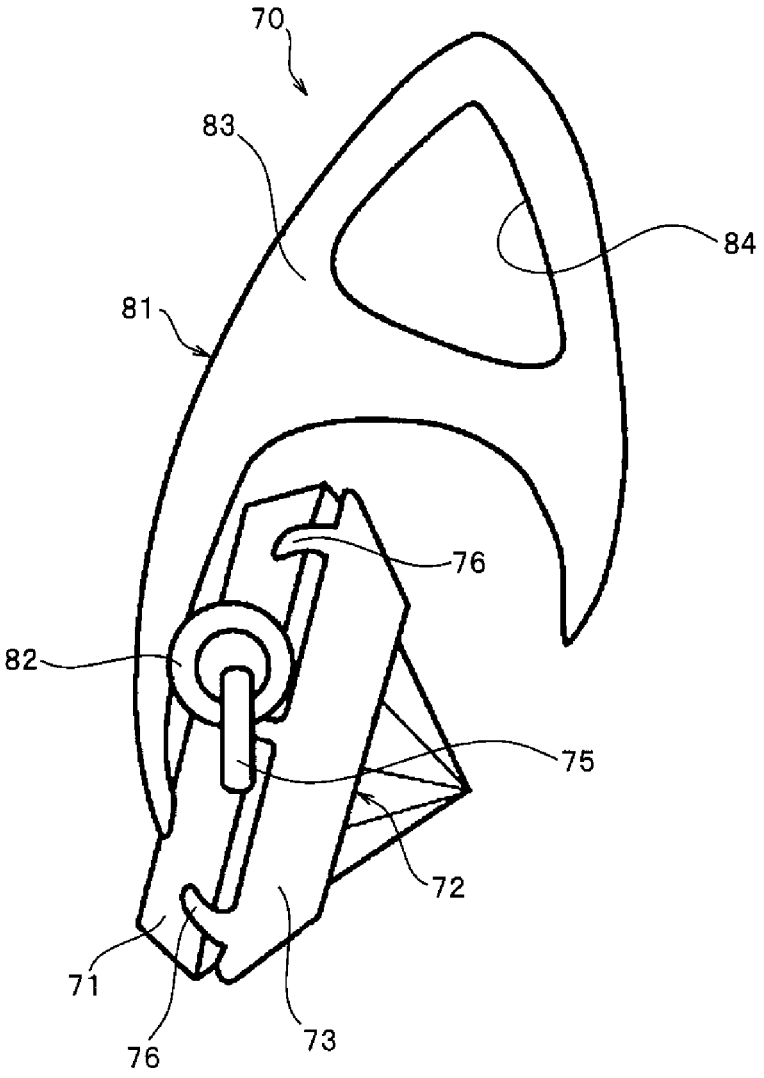
FIG. 20 A side view of the related-art pendant.

FIG. 16 is a front view illustrating a ring according to Example 4. FIG. 17 is a schematic perspective view illustrating a base portion to be used in the ring. FIG. 18 is a schematic view schematically illustrating a main part of the ring.

Note that, also in the description of the ring hereinbelow, similar to the pendant described hereinabove, the three directions orthogonal to each other are referred to as the upper-and-lower direction, the width direction (right-and-left direction), and the front-and-rear direction. Specifically, a direction in which a pair of base-side engaging ring portions 94 described below are arranged with respect to the gemstone 10 is defined as the width direction (right-and-left direction), the direction in which mainly the front side and the back side of the gemstone 10 (for example, table surface and culet portion of the gemstone 10) are oriented is defined as the front-and-rear direction, and the direction orthogonal to the width direction and the front-and-rear direction is defined as the upper-and-lower direction. In other words, the upper-and-lower direction is a direction in which a finger is inserted into the ring, which corresponds to an upper-and-lower direction of the drawing sheet of FIG. 16. Further, the right-and-left direction is a direction that is orthogonal to the direction in which the finger is inserted into the ring. The right-and-left direction is also a direction in which a ring body portion 4*a* extends from a frame portion 100 described below with respect to the ring as viewed with the gemstone 10 being at a center, the right-and-left direction corresponding to a right-and-left direction of the drawing sheet of FIG. 16. The front-and-rear direction is a direction orthogonal to the upper-and-lower direction and the right-and-left direction, which corresponds to a front-and-rear direction of the drawing sheet of FIG. 16. In particular, a direction on a side where the gemstone is visible is defined as the forward side, and a side opposite thereto is defined as the backward side.

A ring 4 according to Example 4 includes the ring body portion 4*a* having an annular shape, a base portion 90 by which a diamond as the gemstone 10 is fixed and held, and the frame portion 100 that is formed integrally with the ring body portion 4*a* and supports the base portion 90 and the gemstone 10. In this case, a part of the frame portion 100 serves as a protective member 103 as described below.

As illustrated in FIG. 17, the base portion 90 of Example 4 includes a base body portion 91 on which the gemstone 10 is set, a plurality of claw portions 92 that are provided to protrude from the base body portion 91 and fix the gemstone 10, right-and-left arm portions 93 that extend from right-and-left lateral rim portions of the base body portion 91 to the outside in the width direction of the base portion 90, and the right-and-left base-side engaging ring portions 94 that are arranged at distal end portions of the right-and-left arm portions 93. The right-and-left arm portions 93 each have a shape which extends from the base body portion 91 to the outside in the right-and-left direction, and in which the base-side engaging ring portion 94 is twisted to be arranged in a posture orthogonal to the base body portion 91. A circular central-opening portion 94*a* is formed at a central portion of each of the right-and-left base-side engaging ring portions 94.

This base portion 90 is formed such that, when the base portion 90 is supported by the frame portion 100 through intermediation of the base-side engaging ring portions 94 and frame-side engaging ring portions 102 described below, the table surface of the gemstone (diamond) 10 to be fixed and held is oriented forward (oriented to a near side of the drawing sheet of FIG. 16, and that the central opening portion 94*a* of each of the base-side engaging ring portions 94 is oriented in the upper-and-lower direction.

The frame portion 100 of Example 4 includes a frame body portion 101, the right-and-left frame-side engaging ring portions 102 that are fixed to an inner-peripheral wall surface of the frame body portion 101, and the protective member 103 that has an annular shape, is formed integrally with the frame body portion 101, and extends inward from an upper end portion of the frame body portion 101.

The frame body portion 101 is formed into a bowl shape including therein a housing region (space) that houses the base portion 90 and the gemstone 10. The frame body portion 101 includes a bottom surface portion 101*a* that is arranged to face the culet of the gemstone 10, and an inner-peripheral wall-surface portion 101*b* that is arranged in a manner of rising from an outer rim portion of the bottom surface portion 101*a*. The inner-peripheral wall-surface portion 101*b* and the bottom surface portion 101*a* of this frame body portion 101 are arranged away from the base portion 90 and the gemstone 10 such that a gap is formed between the gemstone 10 and each of the inner-peripheral wall-surface portion 101*b* and the bottom surface portion 101*a*.

The right-and-left frame-side engaging ring portions 102 each include a circular central-opening portion. The frame-side engaging ring portions 102 are each inclined at an angle of approximately 45° with respect to the front-and-rear direction, and fixed to a boundary part between the frame body portion 101 and the protective member 103 or to a vicinity thereof in a posture that the central opening portion is oriented in a direction obliquely inclined. Although there is no particular problem as long as the frame-side engaging ring portions 102 are fixed to at least one of the frame body portion 101 and the protective member 103, when the frame-side engaging ring portions 102 are fixed to both the frame body portion 101 and the protective member 103, a fixing strength of the frame-side engaging ring portions 102 can be increased.

Note that, in the present invention, the orientation and the posture of the frame-side engaging ring portions 102, and means for fixing the frame-side engaging ring portions 102 to the frame body portion 101 are not particularly limited. For example, the frame-side engaging ring portions 102 may be fixed to the frame body portion 101 or the protective member 103 in a posture parallel to the front-and-rear direction.

The protective member 103 is arranged to extend inward from the upper end portion of the frame body portion 101 to the central portion, and obliquely toward the bottom surface portion 101*a* of the frame body portion 101. Between this protective member 103 and each of the inner-peripheral wall-surface portion 101*b* and the bottom surface portion 101*a* of the frame body portion 101, there is provided a housing compartment (interior space) 104 that houses the right-and-left frame-side engaging ring portions 102 and the base-side engaging ring portions 94 in the state of being engaged with each other.

According to such a ring 4 of Example 4, front sides, rear sides, upper surface sides, lower surface sides, and outer-lateral-surface sides in the width direction of the frame-side engaging ring portions 102, and those of the base-side engaging ring portions 94 in the state of being coupled to each other are covered with the protective member 103 and the bowl-shaped frame body portion 101. With this, entireties of the frame-side engaging ring portions 102, and entireties of the base-side engaging ring portions 94 are protected. In other words, in the front view of the ring 4 as illustrated, for example, in FIG. 16, the frame-side engaging ring portions 102 and the base-side engaging ring portions 94 of Example 4 are at invisible positions behind the protective member 103, and can be prevented from directly receiving the unexpected external force (load) from the outside.

Thus, in the ring 4 of Example 4, during normal use as the ring 4, the state in which the gemstone 10 is minutely and smoothly swingable can be stably maintained for a long duration, and the minute swing of the gemstone 10 can be prevented from being hindered by the entanglement of the threads and the like. As a result, brilliance of the gemstone can look more beautiful, and hence a decorative effect and a high-quality appearance of the ring 4 can be more advantageously enhanced.

Note that, in the present invention, as long as at least the entireties of the right-and-left frame-side engaging ring portions 102 of the frame portion 100, and coupling parts of the right-and-left base-side engaging ring portions 94 with respect to the frame-side engaging ring portions 102 are protected by the protective member 103 and the frame body portion 101, the ring may be manufactured in a manner that, for example, ring parts out of the coupling parts of the base-side engaging ring portions 94 with respect to the frame-side engaging ring portions 102 are partially exposed.

Further, in the cases of Example 1 to Example 3 described above, the personal ornament is the pendant including the pendant 1, 2, or 3, and in the case of Example 4 described above, the personal ornament is the ring. However, the present invention is applicable not only to the pendant and the ring, but also to any other personal ornaments in which a gemstone fixed and held by a base portion is supported to be swingable with respect to a frame portion, such as a pierced earring, a screw-back/clip-on earring, a brooch, a tie clip.

Further, in the cases of Example 1 to Example 4 described above, the frame-side engaging ring portions and the base-side engaging ring portions are each formed into a ring shape overall. However, in the present invention, the frame-side engaging ring portions and the base-side engaging ring portions may each be formed into a circular-arc shape (ring shape) at a part where these are held in contact with each other when being coupled to each other, and into a noncircular-arc shape at other parts. In other words, at least a part of each of the frame-side engaging ring portions and the base-side engaging ring portions may be formed into a circular-arc shape (ring shape).

Further, in each of the cases of Example 1 to Example 4 described above, the single pair of the gemstone and the base portion is arranged correspondingly to the single frame portion. However, the present invention is applicable also to personal ornaments in which a plurality of pairs of gemstones and base portions are arranged with respect to the single frame portion.

Below, Appendices A1 to A14 that relate to an embodiment of the present invention are disclosed.

[Appendix A1] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized by including a protective member that protects, from an outside, at least the right-and-left frame-side engaging ring portions, and coupling parts of the right-and-left base-side engaging ring portions with respect to the frame-side engaging ring portions under the state in which the base-side engaging ring portions and the frame-side engaging ring portions are coupled to each other, the personal ornament being characterized in that the protective member includes:

a front part that covers and protects front sides of the right-and-left frame-side engaging ring portions, and front sides of the coupling parts of the right-and-left base-side engaging ring portions such that the front sides of the right-and-left frame-side engaging ring portions, and the front sides of the coupling parts of the right-and-left base-side engaging ring portions are not exposed; and a rear part that covers and protects rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part.

In the personal ornament according to Appendix A1, the base portion and the gemstone are supported to be swingable with respect to the frame portion under the state in which the base portion and the gemstone are suspended such that a front side of the gemstone (such as table surface) is viewed from a front (the same applies to Appendices A8, B1, B11, C1, and C9 described below).

The gemstone may be, for example, natural gemstones (natural minerals) such as a diamond and a sapphire, may be synthetic gemstones (artificial gemstones) that use synthetic minerals, or may be imitation gemstones that use glass or the like (the same applies to Appendices A8, B1, B11, C1, and C9).

At least a part of each of the pair of right-and-left base-side engaging ring portions, and a part of each of the pair of right-and-left frame-side engaging ring portions are each formed into a circular-arc shape (preferably, annular shape). The right-and-left base-side engaging ring portions and the right-and-left frame-side engaging ring portions are coupled to each other such that respective circular-arc inner rim portions of these engaging ring portions are brought into contact with each other (the same applies to Appendices A8, B1, B11, C1, and C9 described below).

In the personal ornament according to Appendix A1, the right-and-left frame-side engaging ring portions, and the coupling parts of the right-and-left base-side engaging ring portions with respect to the frame-side engaging ring portions are protected from the outside by the protective member. The front sides of the right-and-left frame-side engaging ring portions, and the front sides of the coupling parts of the right-and-left base-side engaging ring portions are protected by being covered with the front part of the protective member so as not to be exposed. The rear sides of the right-and-left frame-side engaging ring portions, and the rear sides of the coupling parts of the right-and-left base-side engaging ring portions are protected by being covered with the rear part of the protective member so as not to be exposed. By such a front part and a rear part, specifically, a front side, a rear side, an upper surface side, a lower surface side, and outer-lateral-surface sides in a width direction of each of the right-and-left frame-side engaging ring portions, and those of each of the coupling parts of the right-and-left base-side engaging ring portions are protected by being covered from the outside so as not to be exposed.

Note that, the coupling parts of the base-side engaging ring portions with respect to the frame-side engaging ring portions refer to ring parts of the base-side engaging ring portions, which are coupled to and held in contact with the frame-side engaging ring portions. These coupling parts (ring parts) include ranges (regions) with which the inner rim portions of the frame-side engaging ring portions are held in sliding contact when the gemstone is minutely swung. In other words, in the base-side engaging ring portions, the circular-arc parts of the base-side engaging ring portions include the coupling parts that are held in sliding contact with the inner rim portions of the frame-side engaging ring portions when the circular-arc parts of the base-side engaging ring portions are coupled to the frame-side engaging ring portions (the same applies to Appendices A8, B1, B11, C1, and C9 described below).

In order not to interfere with the base portion to swing, except a swingable range of the base portion, the protective member is arranged on the outside of the base-side engaging ring portions and the frame-side engaging ring portions in the coupled state (the same applies to Appendices B1 and C1 described below).

In the personal ornament according to Appendix A1, the protective member may protect the base-side engaging ring portions and the frame-side engaging ring portions by the protective member itself. Alternatively, the protective member and a part of the frame portion that is formed separately from the protective member may protect the base-side engaging ring portions and the frame-side engaging ring portions (the same applies to Appendices B1 and C1 described below).

When a personal ornament includes such a protective member, the base portion is stably supported to be swingable with respect to the frame portion through intermediation of the base-side engaging ring portions and the frame-side engaging ring portions. Further, at least the above-described coupling parts of the base-side engaging ring portions and the frame-side engaging rings are protected by being covered with the protective member so as not to be exposed to the outside. In this way, with a simple structure, coupling structure parts at which the base-side engaging ring portions and the frame-side engaging ring portions are coupled to each other such that the gemstone can minutely swing can be prevented from receiving unexpected external force, for example, by direct collision against other objects (the same applies to Appendices B1 and C1 described below).

During normal use of the personal ornament, since the coupling structure parts of the frame-side engaging ring portions and the base-side engaging ring portions are protected, these parts can be advantageously prevented from being damaged and deformed. Thus, shapes of these parts can be stably maintained. As a result, a problem that the minute swinging movement of the gemstone cannot be performed any longer, and a problem that the base portion is disengaged from the frame portion due to the deformation of the frame-side engaging ring portions and the base-side engaging ring portions can be prevented. With this, a state in which the base portion and the gemstone are minutely and smoothly swingable can be stably maintained for a long duration (the same applies to Appendices A8, B1, B11, C1, and C9 described below).

Further, when the base-side engaging ring portions and the frame-side engaging ring portions are protected by the protective member, hair strands, threads, and the like can be prevented from being entangled in the base-side engaging ring portions and the frame-side engaging ring portions. With this, handling properties of the personal ornament can be increased, and the swinging movement of the base portion and the gemstone can be prevented from being hindered by the entanglement of the threads and the like (the same applies to Appendices B1 and C1 described below).

Still further, the base-side engaging ring portions and the frame-side engaging ring portions can be hidden by being covered with the protective member so as not to be visible or difficult to view from the outside. Thus, restriction on design of the personal ornament is relaxed, and hence a degree of freedom in the design can be increased. With this, variations in the design can be easily increased (the same applies to Appendices B1 and C1 described below).

Yet further, the protective member to be used includes the front part and the rear part, and hence the protective member can be formed with a simple structure. The right-and-left base-side engaging ring portions to be provided to the base portion are coupled respectively to the right-and-left frame-side engaging ring portions to be arranged in the frame portion, and then the front part and the rear part are fixed to each other such that these ring portions are protected. In this way, the protective member can be formed. With this, personal ornaments in which the base portion and the gemstone are arranged to be swingable, and in which the base-side engaging ring portions and the frame-side engaging ring portions are protected by the protective member can be easily and stably manufactured (the same applies to Appendices B6 and C4 described below).

[Appendix A2] The personal ornament according to Appendix A1, in which entireties of the frame-side engaging ring portions, and entireties of the base-side engaging ring portions are protected by the protective member.

In the personal ornament according to Appendix A2, at least a front side, a rear side, an upper surface side, a lower surface side, and outer-lateral-surface sides in the width direction of each of the entireties of the base-side engaging ring portions, and at least those of each of the entireties of the frame-side engaging ring portions in the coupled state are stably protected by being covered with the protective member so as not to be exposed to the outside. Thus, the base-side engaging ring portions and the frame-side engaging ring portions in the coupled state can be reliably prevented from receiving the unexpected external force, for example, by the direct collision against other objects. In addition, the state in which the base portion and the gemstone are minutely swingable can be more stably maintained for a long duration (the same applies to Appendices B3 and C2 described below).

[Appendix A3] The personal ornament according to Appendix A1, in which at least parts out of the coupling parts of the base-side engaging ring portions are exposed.

In the personal ornament according to Appendix A3, the frame-side engaging ring portions and the base-side engaging ring portions can be protected by the protective member with at least the parts out of the coupling parts of the base-side engaging ring portions being exposed. Also with this, the state in which the base portion and the gemstone are minutely swingable can be stably maintained for a long duration (the same applies to Appendices B5 and C3 described below).

[Appendix A4] The personal ornament according to any one of Appendix A1 to Appendix A3, in which the front part and the rear part have front-back symmetrical shapes.

In the personal ornament according to Appendix A4, parts (components) having the same shape and made of the same material can be used as the front part and the rear part. With this, the front part and the rear part of the protective member can be prepared at low cost. In addition, at a time when the protective member is attached (assembled) to the personal ornament, the front part and the rear part are not confused with each other. Thus, the operation of attaching the protective member can be prevented from being complicated, and hence the attachment operation can be efficiently performed. Note that, parts having shapes completely different from each other, or parts made of materials completely different from each other may be used as the front part and the rear part (these features apply also to Appendices B7 and C5 described below).

[Appendix A5] The personal ornament according to any one of Appendix A1 to Appendix A4, in which the protective member has a single integral shape that protects, at once, one of the base-side engaging ring portions and one of the frame-side engaging ring portions, the ones being coupled to each other, and another one of the base-side engaging ring portions and another one of the frame-side engaging ring portions, the other ones being coupled to each other.

In the personal ornament according to Appendix A5, the protective member can be formed with a simple structure. Further, the protective member can be easily and stably attached on the outside of the right-and-left base-side engaging ring portions and the right-and-left frame-side engaging ring portions. With this, the base-side engaging ring portions and the frame-side engaging ring portions can be stably protected (the same applies to Appendices B8 and C6 described below).

[Appendix A6] The personal ornament according to any one of Appendix A1 to Appendix A5, in which the protective member forms at least a part of the frame portion, and in which the frame-side engaging ring portions are fixed to an inner surface of the protective member.

In the personal ornament according to Appendix A6, the protective member is formed to serve as at least the part of the frame portion (frame body portion), and the frame-side engaging ring portions are fixed to the inner surface of the protective member. With this, the frame portion can be formed with a simple structure, and the base-side engaging ring portions and the frame-side engaging ring portions in the coupled state can be reliably protected by the protective member forming the frame portion. Note that, the protective member need not necessarily be formed as the part of the frame portion, and the frame portion may be formed separately from the protective member as a member including the frame body portion and the frame-side engaging ring portions (these features apply also to Appendices B9 and C7 described below).

[Appendix A7] The personal ornament according to any one of Appendix A1 to Appendix A6, in which the protective member has a hollow shape.

In the personal ornament according to Appendix A7, the protective member has the hollow shape. With this, the base-side engaging ring portions and the frame-side engaging ring portions in the coupled state can be protected by being stably housed in the protective member. Further, the hollow protective member can be stably formed, for example, by performing press working or the like on a thin metal sheet, and material cost thereof can be reduced to be lower, for example, than that of a solid protective member (the same applies to Appendices B10 and C8 described below).

[Appendix A8] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized in that the frame portion includes:

a front part that covers and protects, under the state in which the base-side engaging ring portions and the frame-side engaging ring portions are coupled to each other, at least front sides of the right-and-left frame-side engaging ring portions, and front sides of coupling parts of the right-and-left base-side engaging ring portions with respect to the frame-side engaging ring portions such that the front sides of the right-and-left frame-side engaging ring portions, and the front sides of the coupling parts of the right-and-left base-side engaging ring portions are not exposed; and a rear part that covers and protects, under the state in which the base-side engaging ring portions and the frame-side engaging ring portions are coupled to each other, at least rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part, the personal ornament being also characterized in that a housing compartment that houses therein and protects, from an outside, at least the frame-side engaging ring portions, and the coupling parts of the base-side engaging ring portions, is arranged between the front part and the rear part.

In the personal ornament according to Appendix A8, the front sides of the right-and-left frame-side engaging ring portions, and the front sides of the coupling parts of the right-and-left base-side engaging ring portions are protected by being covered with the front part of the frame portion so as not to be exposed. Further, the rear sides of the right-and-left frame-side engaging ring portions, and the rear sides of the coupling parts of the right-and-left base-side engaging ring portions are protected by being covered with the rear part of the frame portion so as not to be exposed. The front part and the rear part are fixed to each other, and the housing compartment is arranged therebetween. The frame-side engaging ring portions, and the coupling parts of the base-side engaging ring portions with respect to the frame-side engaging ring portions are housed in the housing compartment, and protected from the outside by the front part and the rear part. By the frame portion (front part and rear part) including such a housing compartment, specifically, the front side, the rear side, the upper surface side, the lower surface side, and the outer-lateral-surface sides in the width direction of each of the right-and-left frame-side engaging ring portions, and those of each of the coupling parts of the right-and-left base-side engaging ring portions are protected by being covered from the outside so as not to be exposed.

In order not to interfere with the base portion to swing, except the swingable range of the base portion, the frame portion including the housing compartment is arranged on the outside of the base-side engaging ring portions and the frame-side engaging ring portions in the coupled state (the same applies to Appendices B11 and C9 described below).

When a personal ornament includes such a housing compartment of the frame portion, the base portion is stably supported to be swingable with respect to the frame portion through intermediation of the base-side engaging ring portions and the frame-side engaging ring portions. Further, at least the above-described coupling parts of the base-side engaging ring portions and the frame-side engaging ring portions are housed in the housing compartment of the frame portion so as not to be exposed to the outside. In this way, with a simple structure, the coupling structure parts at which the base-side engaging ring portions and the frame-side engaging ring portions are coupled to each other such that the gemstone can minutely swing can be prevented from receiving the unexpected external force, for example, by the direct collision against other objects (the same applies to Appendices B11 and C9 described below).

Further, when the base-side engaging ring portions and the frame-side engaging ring portions are protected by being housed in the housing compartment of the frame portion, hair strands, threads, and the like can be prevented from being entangled in the base-side engaging ring portions and the frame-side engaging ring portions. With this, the handling properties of the personal ornament can be increased, and the swinging movement of the base portion and the gemstone can be prevented from being hindered by the entanglement of the threads and the like (the same applies to Appendices B11 and C9 described below).

Still further, the base-side engaging ring portions and the frame-side engaging ring portions can be hidden by being held in the housing compartment of the frame portion so as not to be visible or difficult to view from the outside. Thus, the restriction on the design of the personal ornament is relaxed, and hence the degree of freedom in the design can be increased. With this, the variations in the design can be easily increased (the same applies to Appendices B11 and C9 described below).

The frame portion (frame body portion) to be used includes the front part and the rear part, and hence the frame portion can be formed with a simple structure. The right-and-left base-side engaging ring portions to be provided to the base portion are coupled respectively to the right-and-left frame-side engaging ring portions to be provided to the front part or the rear part, and then the front part and the rear part are fixed to each other such that these ring portions are protected. In this way, the frame portion (frame body portion) can be formed. With this, personal ornaments in which the base portion and the gemstone are arranged to be swingable, and in which the base-side engaging ring portions and the frame-side engaging ring portions are protected by the frame portion can be easily and stably manufactured (the same applies to Appendices B16 and C12 described below).

[Appendix A9] The personal ornament according to Appendix A8, in which entireties of the frame-side engaging ring portions, and entireties of the base-side engaging ring portions are housed in the housing compartment.

In the personal ornament according to Appendix A9, the entireties of the frame-side engaging ring portions, and the entireties of the base-side engaging ring portions are housed in the housing compartment of the frame portion. With this, the entireties of the frame-side engaging ring portions, and the entireties of the base-side engaging ring portions are protected by the frame portion. In this way, the front side, the rear side, the upper surface side, the lower surface side, and the outer-lateral-surface sides in the width direction of each of the right-and-left frame-side engaging ring portions, and those of each of the coupling parts of the right-and-left base-side engaging ring portions are stably protected by being hidden so as not to be exposed to the outside. Thus, the base-side engaging ring portions and the frame-side engaging ring portions in the coupled state can be reliably prevented from receiving the unexpected external force, for example, by the direct collision against other objects. In addition, the state in which the base portion and the gemstone are minutely swingable can be more stably maintained for a long duration (the same applies to Appendices B13 and C10 described below).

[Appendix A10] The personal ornament according to Appendix A8, in which at least parts out of the coupling parts of the base-side engaging ring portions are exposed.

In the personal ornament according to Appendix A10, the frame-side engaging ring portions and the base-side engaging ring portions are housed in the housing compartment of the frame portion with at least the parts out of the coupling parts of the base-side engaging ring portions being exposed. Also with this, the state in which the base portion and the gemstone are minutely swingable can be stably maintained for a long duration (the same applies to Appendices B15 and C11 described below).

[Appendix A11] The personal ornament according to any one of Appendix A8 to Appendix A10, in which the front part and the rear part have front-back symmetrical shapes, and in which a frame body portion of the frame portion has a hollow shape that forms the housing compartment.

In the personal ornament according to Appendix A11, parts (components) having the same shape and made of the same material can be used as the front part and the rear part. With this, the front part and the rear part can be prepared at low cost. Further, the hollow frame-body portion can be stably formed, for example, by performing the press working or the like on a thin metal sheet, and material cost thereof can be reduced to be lower than that of a solid frame-body portion (the same applies to Appendices B16 and C12 described below).

[Appendix A12] The personal ornament according to any one of Appendix A1 to Appendix A11, in which the frame portion includes an insertion opening portion that allows a part of the base portion to be inserted therethrough, and in which the insertion opening portion allows the base portion and the gemstone to swing, and has a size that restricts a swing range of the base portion and the gemstone.

In the personal ornament according to Appendix A12, the state in which the base portion and the gemstone are minutely and smoothly swingable can be stably maintained. Further, the swing range of the base portion and the gemstone is restricted by the frame portion. Thus, the gemstone can be properly swung in a range in which the gemstone looks beautifully sparkly as viewed from the front. With this, a decorative effect by the swing can be more advantageously obtained (the same applies to Appendices B17 and C13 described below).

[Appendix A13] The personal ornament according to any one of Appendix A1 to Appendix A12, in which, in a front view of the personal ornament, the frame portion has a shape which surrounds an outer periphery of the gemstone held by the base portion, and in which a gap is formed between the frame portion and the gemstone.

In the personal ornament according to Appendix A13, peripheries of the base portion and the gemstone can be protected overall by the frame portion. Further, with respect to the frame portion arranged in a vicinity of the outer periphery of the base portion and that of the gemstone, the gemstone looks floating in the air, and the base portion and the gemstone minutely swing. With this, the swing of the gemstone is easily emphasized. As a result, brilliance of the gemstone held by the base portion can look more beautiful, and hence a decorative effect and a high-quality appearance of the personal ornament can be more advantageously enhanced. Further, the personal ornament can have an unprecedented brand-new image (sense of beauty). In addition, the frame portion is arranged around the base portion and the gemstone. Thus, at the time when the base portion and the gemstone swing, the base portion and the gemstone can be prevented from coming into contact with clothes or the like of a user. With this, the swing of the base portion and the gemstone can be restrained from being interrupted by the contact with the clothes or the like (these features apply also to Appendices B19 and C14 described below).

[Appendix A14] The personal ornament according to any one of Appendix A1 to Appendix A13, in which, in a side view of the personal ornament, in a front-and-rear direction of the personal ornament, a back-side end surface of the frame portion is arranged at a position further on a back side with respect to a position of a back-surface-side distal end portion of the swingable gemstone.

In the personal ornament according to Appendix A14, at a time when the personal ornament is worn, the gemstone (specifically, back-surface-side distal end portion of the gemstone) can be prevented from coming into direct contact with the close or the like. Thus, the swing of the base portion and the gemstone can be more advantageously restrained from being interrupted by the contact with the clothes or the like. With this, the swing of the base portion and the gemstone can be naturally continued for a long duration (the same applies to Appendices B20 and C15 described below).

Next, Appendices B1 to B20 that relate to another embodiment of the present invention are disclosed.

[Appendix B1] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized by including a protective member that covers and protects, from an outside, under the state in which the base-side engaging ring portions and the frame-side engaging ring portions are coupled to each other, at least a front side, a rear side, an upper surface side, a lower surface side, and outer-lateral-surface sides in a width direction of each of the right-and-left frame-side engaging ring portions, and at least a front side, a rear side, an upper surface side, a lower surface side, and outer-lateral-surface sides in the width direction of a coupling part of each of the right-and-left base-side engaging ring portions with respect to the frame-side engaging ring portions such that the front side, the rear side, the upper surface side, the lower surface side, and the outer-lateral-surface sides in the width direction of each of the right-and-left frame-side engaging ring portions, and the front side, the rear side, the upper surface side, the lower surface side, and the outer-lateral-surface sides in the width direction of the coupling part of each of the right-and-left base-side engaging ring portions with respect to the frame-side engaging ring portions are not exposed.

In the personal ornament according to Appendix B1, the front side, the rear side, the upper surface side, the lower surface side, and the outer-lateral-surface sides in the width direction of each of the right-and-left frame-side engaging ring portions, and those of the coupling part of each of the right-and-left base-side engaging ring portions with respect to the frame-side engaging ring portions are protected by being covered from the outside with the protective member so as not to be exposed.

[Appendix B2] The personal ornament according to Appendix B1, in which at least a part of each of the base-side engaging ring portions is formed into a circular-arc shape, in which at least a part of each of the frame-side engaging ring portions is formed into a circular-arc shape, in which the base portion and the gemstone are supported to be swingable with respect to the frame portion under the state in which the base portion and the gemstone are suspended such that a table surface of the gemstone is viewed from a front, in which, in the right-and-left base-side engaging ring portions, the circular-arc parts of the base-side engaging ring portions each include the coupling part that is held in sliding contact with an inner rim portion of corresponding one of the frame-side engaging ring portions when the circular-arc parts of the base-side engaging ring portions are coupled to the frame-side engaging ring portions, in which, in a case where, as three directions orthogonal to each other in the personal ornament, a direction in which the pair of base-side engaging ring portions are arranged with respect to the gemstone is defined as the width direction, a direction in which mainly the table surface and a culet portion of the gemstone are oriented is defined as a front-and-rear direction, and a direction orthogonal to the width direction and the front-and-rear direction is defined as an upper-and-lower direction, the protective member continuously covers and protects, from the outside, at least the front side in the front-and-rear direction, the rear side in the front-and-rear direction, the upper surface side, the lower surface side, and the outer-lateral-surface sides in the width direction of each of the right-and-left frame-side engaging ring portions, and at least the front side in the front-and-rear direction, the rear side in the front-and-rear direction, the upper surface side, the lower surface side, and the outer-lateral-surface sides in the width direction of the coupling part of each of the right-and-left base-side engaging ring portions such that the front side in the front-and-rear direction, the rear side in the front-and-rear direction, the upper surface side, the lower surface side, and the outer-lateral-surface sides in the width direction of each of the right-and-left frame-side engaging ring portions, and the front side in the front-and-rear direction, the rear side in the front-and-rear direction, the upper surface side, the lower surface side, and the outer-lateral-surface sides in the width direction of the coupling part of each of the right-and-left base-side engaging ring portions are not exposed.

[Appendix B3] The personal ornament according to Appendix B1 or Appendix B2, in which the protective member protects entireties of the frame-side engaging ring portions, and entireties of the base-side engaging ring portions.

[Appendix B4] The personal ornament according to Appendix B3, in which the base-side engaging ring portions and the frame-side engaging ring portions are each formed into an annular shape, in which the protective member continuously covers and protects, from the outside, the entireties of the frame-side engaging ring portions, and the entireties of the base-side engaging ring portions such that the front side in the front-and-rear direction, the rear side in the front-and-rear direction, the upper surface side, the lower surface side, and the outer-lateral-surface sides in the width direction of each of the frame-side engaging ring portions, and the front side in the front-and-rear direction, the rear side in the front-and-rear direction, the upper surface side, the lower surface side, and the outer-lateral-surface sides in the width direction of each of the base-side engaging ring portions are not exposed.

[Appendix B5] The personal ornament according to Appendix B1 or Appendix B2, in which at least parts out of the coupling part of each of the base-side engaging ring portions are exposed.

[Appendix B6] The personal ornament according to any one of Appendix B1 to Appendix B5, in which the protective member includes:

a front part that protects the front side of the coupling part of each of the base-side engaging ring portions and corresponding one of the frame-side engaging ring portions; and a rear part that protects the rear side of the coupling part of each of the base-side engaging ring portions and the corresponding one of the frame-side engaging ring portions, the rear part being fixed to the front part.

[Appendix B7] The personal ornament according to Appendix B6, in which the front part and the rear part have front-back symmetrical shapes.

[Appendix B8] The personal ornament according to any one of Appendix B1 to Appendix B7, in which the protective member has a single integral shape that protects, at once, one of the base-side engaging ring portions and one of the frame-side engaging ring portions, the ones being coupled to each other, and another one of the base-side engaging ring portions and another one of the frame-side engaging ring portions, the other ones being coupled to each other.

[Appendix B9] The personal ornament according to any one of Appendix B1 to Appendix B8, in which the protective member forms at least a part of the frame portion, and in which the frame-side engaging ring portions are fixed to an inner surface of the protective member.

[Appendix B10] The personal ornament according to any one of Appendix B1 to Appendix B9, in which the protective member has a hollow shape.

[Appendix B11] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended, the personal ornament being characterized in that the frame portion includes a housing compartment that houses therein at least the frame-side engaging ring portions, and coupling parts of the base-side engaging ring portions with respect to the frame-side engaging ring portions under the state in which the base-side engaging ring portions and the frame-side engaging ring portions are coupled to each other, and that covers and protects, from an outside, a front side, a rear side, an upper surface side, a lower surface side, and outer-lateral-surface sides in a width direction of each of the right-and-left frame-side engaging ring portions, and a front side, a rear side, an upper surface side, a lower surface side, and outer-lateral-surface sides in the width direction of each of the coupling parts of the right-and-left base-side engaging ring portions such that the front side, the rear side, the upper surface side, the lower surface side, and the outer-lateral-surface sides in the width direction of each of the right-and-left frame-side engaging ring portions, and the front side, the rear side, the upper surface side, the lower surface side, and the outer-lateral-surface sides in the width direction of each of the coupling parts of the right-and-left base-side engaging ring portions are not exposed.

In the personal ornament according to Appendix B11, the frame-side engaging ring portions, and the coupling parts of the base-side engaging ring portions with respect to the frame-side engaging ring portions are housed in the housing compartment of the frame portion. With this, the front side, the rear side, the upper surface side, the lower surface side, and the outer-lateral-surface sides in the width direction of each of the right-and-left frame-side engaging ring portions, and those of each of the coupling parts of the right-and-left base-side engaging ring portions with respect to the frame-side engaging ring portions are protected by being covered from the outside with the frame portion so as not to be exposed.

[Appendix B12] The personal ornament according to Appendix B11, in which at least a part of each of the base-side engaging ring portions is formed into a circular-arc shape, in which at least a part of each of the frame-side engaging ring portions is formed into a circular-arc shape, in which the base portion and the gemstone are supported to be swingable with respect to the frame portion under the state in which the base portion and the gemstone are suspended such that a table surface of the gemstone is viewed from a front, in which, in the right-and-left base-side engaging ring portions, the circular-arc parts of the base-side engaging ring portions include the coupling parts that are held in sliding contact with inner rim portions of the frame-side engaging ring portions when the circular-arc parts of the base-side engaging ring portions are coupled to the frame-side engaging ring portions, in which, in a case where, as three directions orthogonal to each other in the personal ornament, a direction in which the pair of base-side engaging ring portions are arranged with respect to the gemstone is defined as the width direction, a direction in which mainly the table surface and a culet portion of the gemstone are oriented is defined as a front-and-rear direction, and a direction orthogonal to the width direction and the front-and-rear direction is defined as an upper-and-lower direction, the housing compartment houses therein the frame-side engaging ring portions, and the coupling parts of the base-side engaging ring portions, and continuously covers and protects, from the outside, at least the front side in the front-and-rear direction, the rear side in the front-and-rear direction, the upper surface side, the lower surface side, and the outer-lateral-surface sides in the width direction of each of the right-and-left frame-side engaging ring portions, and at least the front side in the front-and-rear direction, the rear side in the front-and-rear direction, the upper surface side, the lower surface side, and the outer-lateral-surface sides in the width direction of each of the coupling parts of the right-and-left base-side engaging ring portions such that the front side in the front-and-rear direction, the rear side in the front-and-rear direction, the upper surface side, the lower surface side, and the outer-lateral-surface sides in the width direction of each of the right-and-left frame-side engaging ring portions, and the front side in the front-and-rear direction, the rear side in the front-and-rear direction, the upper surface side, the lower surface side, and the outer-lateral-surface sides in the width direction of each of the coupling parts of the right-and-left base-side engaging ring portions are not exposed.

[Appendix B13] The personal ornament according to Appendix B11 or Appendix B12, in which the housing compartment houses entireties of the frame-side engaging ring portions, and entireties of the base-side engaging ring portions.

[Appendix B14] The personal ornament according to Appendix B13, in which the base-side engaging ring portions and the frame-side engaging ring portions are each formed into an annular shape, in which the housing compartment continuously covers and houses, from the outside, the entireties of the frame-side engaging ring portions, and the entireties of the base-side engaging ring portions such that the front side in the front-and-rear direction, the rear side in the front-and-rear direction, the upper surface side, the lower surface side, and the outer-lateral-surface sides in the width direction of each of the frame-side engaging ring portions, and the front side in the front-and-rear direction, the rear side in the front-and-rear direction, the upper surface side, the lower surface side, and the outer-lateral-surface sides in the width direction of each of the base-side engaging ring portions are not exposed.

[Appendix B15] The personal ornament according to Appendix B11 or Appendix B12, in which at least parts out of the coupling parts of the base-side engaging ring portions are exposed.

[Appendix B16] The personal ornament according to any one of Appendix B11 to Appendix B15, in which a frame body portion of the frame portion includes:

a front part that protects the front side of the coupling part of each of the base-side engaging ring portions and corresponding one of the frame-side engaging ring portions; and a rear part that protects the rear side of the coupling part of each of the base-side engaging ring portions and the corresponding one of the frame-side engaging ring portions, the rear part being fixed to the front part, in which the front part and the rear part have front-back symmetrical shapes, and in which the frame body portion has a hollow shape that forms the housing compartment.

[Appendix B17] The personal ornament according to any one of Appendix B1 to Appendix B16, in which the frame portion includes an insertion opening portion that allows a part of the base portion to be inserted therethrough, and in which the insertion opening portion allows the base portion and the gemstone to swing, and has a size that restricts a swing range of the base portion and the gemstone.

[Appendix B18] The personal ornament according to Appendix B17, in which the base portion includes:

a base body on which the gemstone is set, fixed, and held; and right-and-left arm portions that couple the base body portion and the right-and-left base-side engaging ring portions to each other, and in which the insertion opening portion allows the arm portions of the base portion to be inserted therethrough.

[Appendix B19] The personal ornament according to any one of Appendix B1 to Appendix B18, in which, in a front view of the personal ornament, the frame portion has a shape which surrounds an outer periphery of the gemstone held by the base portion, and in which a gap is formed between the frame portion and the gemstone.

[Appendix B20] The personal ornament according to any one of Appendix B1 to Appendix B19, in which, in a side view of the personal ornament, in the front-and-rear direction of the personal ornament, a back-side end surface of the frame portion is arranged at a position further on a back side with respect to a position of a back-surface-side distal end portion of the swingable gemstone.

Next, Appendices C1 to C15 that relate to still another embodiment of the present invention are disclosed.

[Appendix C1] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion, the personal ornament being characterized by including a protective member that protects, from an outside, at least the frame-side engaging ring portions, and coupling parts of the base-side engaging ring portions with respect to the frame-side engaging ring portions under the state in which the base-side engaging ring portions and the frame-side engaging ring portions are coupled to each other.

In the personal ornament according to Appendix C1, the right-and-left frame-side engaging ring portions, and the coupling parts of the right-and-left base-side engaging ring portions with respect to the frame-side engaging ring portions are protected from the outside by the protective member. Specifically, a front side, a rear side, an upper surface side, a lower surface side, and outer-lateral-surface sides in a width direction of each of the right-and-left frame-side engaging ring portions, and those of each of the coupling parts of the right-and-left base-side engaging ring portions are protected by being covered from the outside with this protective member so as not to be exposed.

[Appendix C2] The personal ornament according to Appendix C1, in which entireties of the frame-side engaging ring portions, and entireties of the base-side engaging ring portions are protected by the protective member.

[Appendix C3] The personal ornament according to Appendix C1, in which at least parts out of the coupling parts of the base-side engaging ring portions are exposed.

[Appendix C4] The personal ornament according to any one of Appendix C1 to Appendix C3, in which the protective member includes:

a front part that protects fronts of the base-side engaging ring portions, and fronts of the frame-side engaging ring portions; and a rear part that protects rears of the base-side engaging ring portions, and rears of the frame-side engaging ring portions, the rear part being fixed to the front part.

[Appendix C5] The personal ornament according to Appendix C4, in which the front part and the rear part have front-back symmetrical shapes.

[Appendix C6] The personal ornament according to any one of Appendix C1 to Appendix C5, in which the protective member has a single integral shape that protects, at once, one of the base-side engaging ring portions and one of the frame-side engaging ring portions, the ones being coupled to each other, and another one of the base-side engaging ring portions and another one of the frame-side engaging ring portions, the other ones being coupled to each other.

[Appendix C7] The personal ornament according to any one of Appendix C1 to Appendix C6, in which the protective member forms at least a part of the frame portion, and in which the frame-side engaging ring portions are fixed to an inner surface of the protective member.

[Appendix C8] The personal ornament according to any one of Appendix C1 to Appendix C7, in which the protective member has a hollow shape.

[Appendix C9] A personal ornament, including:

a base portion that fixes and holds a gemstone; and a frame portion that supports the base portion, the base portion including a pair of right-and-left base-side engaging ring portions that are arranged at positions opposite to each other across the gemstone, the frame portion including a pair of right-and-left frame-side engaging ring portions to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion, the personal ornament being characterized in that the frame portion includes a housing compartment that houses therein and protects, from an outside, at least the frame-side engaging ring portions, and coupling parts of the base-side engaging ring portions with respect to the frame-side engaging ring portions under the state in which the base-side engaging ring portions and the frame-side engaging ring portions are coupled to each other.

In the personal ornament according to Appendix C9, the frame-side engaging ring portions, and the coupling parts of the base-side engaging ring portions with respect to the frame-side engaging ring portions are protected from the outside by being housed in the housing compartment of the frame portion. With this, specifically, a front side, a rear side, an upper surface side, a lower surface side, and outer-lateral-surface sides in a width direction of each of the right-and-left frame-side engaging ring portions, and those of each of the coupling parts of the right-and-left base-side engaging ring portions with respect to the frame-side engaging ring portions are protected by being covered from the outside with the frame portion so as not to be exposed.

[Appendix C10] The personal ornament according to Appendix C9, in which entireties of the frame-side engaging ring portions, and entireties of the base-side engaging ring portions are housed in the housing compartment.

[Appendix C11] The personal ornament according to Appendix C9, in which at least parts out of the coupling parts of the base-side engaging ring portions are exposed.

[Appendix C12] The personal ornament according to any one of Appendix C9 to Appendix C11, in which a frame body portion of the frame portion includes:

a front part that protects fronts of the base-side engaging ring portions, and fronts of the frame-side engaging ring portions; and a rear part that protects rears of the base-side engaging ring portions, and rears of the frame-side engaging ring portions, the rear part being fixed to the front part, in which the front part and the rear part have front-back symmetrical shapes, and in which the frame body portion has a hollow shape that forms the housing compartment.

[Appendix C13] The personal ornament according to any one of Appendix C1 to Appendix C12, in which the frame portion includes an insertion opening portion that allows a part of the base portion to be inserted therethrough, and in which the insertion opening portion allows the base portion and the gemstone to swing, and has a size that restricts a swing range of the base portion and the gemstone.

[Appendix C14] The personal ornament according to any one of Appendix C1 to Appendix C13, in which, in a front view of the personal ornament, the frame portion has a shape which surrounds an outer periphery of the gemstone held by the base portion, and in which a gap is formed between the frame portion and the gemstone.

[Appendix C15] The personal ornament according to any one of Appendix C1 to Appendix C14, in which, in a side view of the personal ornament, in a front-and-rear direction of the personal ornament, a back-side end surface of the frame portion is arranged at a position further on a back side with respect to a position of a back-surface-side distal end portion of the swingable gemstone.

REFERENCE SIGNS LIST

1, 1*a*, 1*c* pendant
2, 3 pendant
4 ring
4*a* ring body portion
5 chain
6 user
10 gemstone (diamond)
11 back-surface-side distal end portion (culet portion)
20 base portion
21 base body portion
21*a* opening portion
22 claw portion
23 arm portion
24, 24*c* base-side engaging ring portion
24*a* central opening portion
30 frame portion
31, 31*a* frame body portion (protective member)
31*b* frame body portion
32, 32*c* frame-side engaging ring portion
33 chain link portion
34 interior space (housing compartment)
35, 35*b* inner peripheral slot
36 front part
37 rear part
40 frame portion
41 frame body portion (protective member)
42 frame-side engaging ring portion
43 chain link portion
46 front part
47 rear part
50 frame portion
51 frame body portion
52 frame-side engaging ring portion
53 chain-link hole portion
54 ring housing portion
60 protective member
61 back-wall portion
62 outer-lateral-wall portion
63 bottom wall portion
90 base portion
91 base body portion
92 claw portion
93 arm portion
94 base-side engaging ring portion
94*a* central opening portion
100 frame portion
101 frame body portion
101*a* bottom surface portion
101*b* inner-peripheral wall-surface portion
102 frame-side engaging ring portion
103 protective member
104 housing compartment (interior space)

O contact point

α inclination angle

The invention claimed is:

1. A personal ornament, comprising:

a base portion that fixes and holds a gemstone; and a frame portion that supports the base portion, the base portion comprises a pair of right-and-left base-side engaging ring portions that are arranged at positions opposite to each other across the gemstone, the frame portion comprises a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended and the right-and-left base-side engaging ring portions are each formed into a pair of opposed tapered shapes being gradually narrowed toward an inner rim in a cross-section orthogonal to a circumferential direction, the personal ornament further comprising:

a protective member that protects, from an outside, at least the right-and-left frame-side engaging ring portions, and coupling parts of the right-and-left base-side engaging ring portions with respect to the frame-side engaging ring portions under the state in which the base-side engaging ring portions and the frame-side engaging ring portions are coupled to each other, wherein the protective member comprises:

a front part that covers and protects front sides of the right-and-left frame-side engaging ring portions, and front sides of the coupling parts of the right-and-left base-side engaging ring portions such that the front sides of the right-and-left frame-side engaging ring portions, and the front sides of the coupling parts of the right-and-left base-side engaging ring portions are not exposed; and a rear part that covers and protects rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part; wherein the protective member further covers and protects, from the outside, outer lateral surfaces in the width direction of each of the right-and-left frame-side engaging ring portions and each of right-and-left base-side engaging ring portions in the coupled state such that these surfaces are not exposed;

wherein a position of a center of gravity of the base portion and the gemstone as a whole is arranged on a rear side with respect to positions of contact points of the right-and-left base-side engaging ring portions and the right-and-left frame-side engaging ring portions, such that a table surface of the gemstone is inclined obliquely upward under a state in which the gemstone and the base portion are suspended with respect to the frame portion held along a gravity direction.

2. The personal ornament according to claim 1, wherein entireties of the frame-side engaging ring portions, and entireties of the base-side engaging ring portions are protected by the protective member.

3. The personal ornament according to claim 1, wherein at least parts out of the coupling parts of the base-side engaging ring portions are exposed.

4. The personal ornament according to claim 1, wherein the front part and the rear part have front-back symmetrical shapes.

5. The personal ornament according to claim 1, wherein the protective member has a single integral shape that protects, at once, one of the base-side engaging ring portions and one of the frame-side engaging ring portions, the ones being coupled to each other, and another one of the base-side engaging ring portions and another one of the frame-side engaging ring portions, the other ones being coupled to each other.

6. The personal ornament according to claim 1, wherein the protective member forms at least a part of the frame portion, and wherein the frame-side engaging ring portions are fixed to an inner surface of the protective member.

7. The personal ornament according to claim 1, wherein the protective member has a hollow shape.

8. The personal ornament according to claim 1, wherein the frame portion includes an insertion opening portion that allows a part of the base portion to be inserted therethrough, and wherein the insertion opening portion allows the base portion and the gemstone to swing, and has a size that restricts a swing range of the base portion and the gemstone.

9. The personal ornament according to claim 1, wherein, in a front view of the personal ornament, the frame portion has a shape which surrounds an outer periphery of the gemstone held by the base portion, and in which a gap is formed between the frame portion and the gemstone.

10. A personal ornament, comprising:

a base portion that fixes and holds a gemstone; and a frame portion that supports the base portion, the base portion comprising a pair of right-and-left base-side engaging ring portions that are arranged at positions opposite to each other across the gemstone, the frame portion comprising a pair of right-and-left frame-side engaging ring portions which are fixed to the frame portion, and to which the right-and-left base-side engaging ring portions are respectively coupled and engaged, the right-and-left base-side engaging ring portions being coupled respectively to the right-and-left frame-side engaging ring portions such that the base portion and the gemstone are supported to be swingable with respect to the frame portion under a state in which the base portion and the gemstone are suspended and the right-and-left base-side engaging ring portions are each formed into a pair of opposed tapered shapes being gradually narrowed toward an inner rim in a cross-section orthogonal to a circumferential direction, and wherein the frame portion comprises:

a front part that covers and protects, under the state in which the base-side engaging ring portions and the frame-side engaging ring portions are coupled to each other, at least front sides of the right-and-left frame-side engaging ring portions, and front sides of coupling parts of the right-and-left base-side engaging ring portions with respect to the frame-side engaging ring portions such that the front sides of the right-and-left frame-side engaging ring portions, and the front sides of the coupling parts of the right-and-left base-side engaging ring portions are not exposed; and a rear part that covers and protects, under the state in which the base-side engaging ring portions and the frame-side engaging ring portions are coupled to each other, at least rear sides of the right-and-left frame-side engaging ring portions, and rear sides of the coupling parts of the right-and-left base-side engaging ring portions such that the rear sides of the right-and-left frame-side engaging ring portions, and the rear sides of the coupling parts of the right-and-left base-side engaging ring portions are not exposed, the rear part being fixed to the front part, the personal ornament being also characterized in that a housing compartment that houses therein and protects, from an outside, at least the frame-side engaging ring portions, and the coupling parts of the base-side engaging ring portions, is arranged between the front part and the rear part; wherein the frame portion further covers and protects, from the outside, outer lateral surfaces in the width direction of each of the right-and-left frame-side engaging ring portions and each of right-and-left base-side engaging ring portions in the coupled state such that these surfaces are not exposed;

wherein a position of a center of gravity of the base portion and the gemstone as a whole is arranged on a rear side with respect to positions of contact points of the right-and-left base-side engaging ring portions and the right-and-left frame-side engaging ring portions, such that a table surface of the gemstone is inclined obliquely upward under a state in which the gemstone and the base portion are suspended with respect to the frame portion held along a gravity direction.

11. The personal ornament according to claim 10, wherein entireties of the frame-side engaging ring portions, and entireties of the base-side engaging ring portions are housed in the housing compartment.

12. The personal ornament according to claim 10, wherein at least parts out of the coupling parts of the base-side engaging ring portions are exposed.

13. The personal ornament according to claim 10, wherein the front part and the rear part have front-back symmetrical shapes, and wherein a frame body portion of the frame portion has a hollow shape that forms the housing compartment.

* * * * *